US009789723B2

(12) United States Patent
Tachibana

(10) Patent No.: US 9,789,723 B2
(45) Date of Patent: Oct. 17, 2017

(54) PRINTING APPARATUS CAPABLE OF CONTROLLING ORDER OF IMAGE FORMATION ON A PLURALITY OF PAGES TO BE POST-PROCESSED, METHOD OF CONTROLLING THE PRINTING APPARATUS, AND STORAGE MEDIUM

(71) Applicant: CANON KABUSHIKI KAISHA, Tokyo (JP)

(72) Inventor: Yoshiro Tachibana, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 939 days.

(21) Appl. No.: 14/078,606

(22) Filed: Nov. 13, 2013

(65) Prior Publication Data

US 2014/0133938 A1 May 15, 2014

(30) Foreign Application Priority Data

Nov. 13, 2012 (JP) ..... 2012-249426

(51) Int. Cl.
*B42C 1/12* (2006.01)
*B42B 4/00* (2006.01)
(Continued)

(52) U.S. Cl.
CPC ..... *B42C 1/12* (2013.01); *B42B 4/00* (2013.01); *B42C 19/02* (2013.01); *G03G 15/6544* (2013.01); *G03G 2215/00831* (2013.01)

(58) Field of Classification Search
CPC ..... G03G 15/6541; G03G 15/6544; G03G 2215/00818; G03G 2215/00822;
(Continued)

(56) References Cited

U.S. PATENT DOCUMENTS 5,481,354 A 1/1996 Nakajima
5,722,031 A 2/1998 Fujii et al.
(Continued)

FOREIGN PATENT DOCUMENTS

CN 101004669 A 7/2007
CN 101780900 A 7/2010
(Continued)

OTHER PUBLICATIONS

Chinese Office Action issued in Chinese counterpart application No. CN201310572283.2, dated Mar. 30, 2015. English translation provided.

(Continued)

*Primary Examiner* — David Banh
(74) *Attorney, Agent, or Firm* — Rossi, Kimms & McDowell LLP

(57) ABSTRACT

A mechanism that makes it possible to output a saddle-stitched brochure in a correct page order when a post-processing apparatus that executes a saddle-stitching process by switching back a sheet is caused to execute the saddle-stitching process. Sheets discharged from a printing apparatus are switched back by reverse rotation of a conveying roller pair, and are conveyed into a conveying path for a saddle-stitch bookbinding process. The sheets are accumulated in an accumulation tray for the saddle-stitch bookbinding process. When the saddle-stitch bookbinding process is caused to be executed on the accumulated sheets by the post-processing apparatus, the order of image formation is decided such that the order of pages of images printed on the saddle-stitched sheets becomes correct. The images are printed on the sheets in the decided order of image formation.

13 Claims, 24 Drawing Sheets

(51) Int. Cl.
*B42C 19/02* (2006.01)
*G03G 15/00* (2006.01)

(58) Field of Classification Search
CPC ..... G03G 2215/00827; B65H 2801/48; B65H 2408/12; B65H 2408/121; B65H 2301/163; B42C 1/00; B42C 1/10; B42C 1/12; B42C 1/125
See application file for complete search history.

(56) References Cited

U.S. PATENT DOCUMENTS

| | | | | |
|---|---|---|---|---|
| 8,672,312 | B2 | 3/2014 | Nonaka | |
| 2001/0016124 | A1* | 8/2001 | Shiramura | G03G 15/6541 399/82 |
| 2007/0017397 | A1* | 1/2007 | Kamata | G03G 15/6538 101/483 |
| 2008/0170262 | A1* | 7/2008 | Takahashi | G03G 15/6538 358/1.15 |
| 2008/0211158 | A1 | 9/2008 | Fukasawa et al. | |
| 2010/0183405 | A1 | 7/2010 | Nonaka | |
| 2011/0242555 | A1* | 10/2011 | Nakajima | G06K 15/1822 358/1.9 |
| 2012/0069367 | A1 | 3/2012 | Iguchi | |
| 2014/0023418 | A1* | 1/2014 | Kashiwagi | G03G 15/502 399/410 |
| 2014/0140747 | A1* | 5/2014 | Osada | G03G 15/6544 399/410 |
| 2015/0310316 | A1* | 10/2015 | Osada | G06K 15/16 358/1.12 |
| 2016/0214828 | A1* | 7/2016 | Osada | B65H 45/30 |

FOREIGN PATENT DOCUMENTS

| | | | |
|---|---|---|---|
| CN | 102411293 | A | 4/2012 |
| GB | 2288793 | A | 11/1995 |
| JP | 08036328 | A | 2/1996 |
| JP | 2002-331730 | A | 11/2002 |
| JP | 2005007597 | A | 1/2005 |
| JP | 2005238757 | A | 9/2005 |
| JP | 2008184326 | A | 8/2008 |
| JP | 2010-168134 | A | 8/2010 |

OTHER PUBLICATIONS

Office Action issued in Japanese Application No. JP2012-249426, mailed Aug. 23, 2016.

* cited by examiner

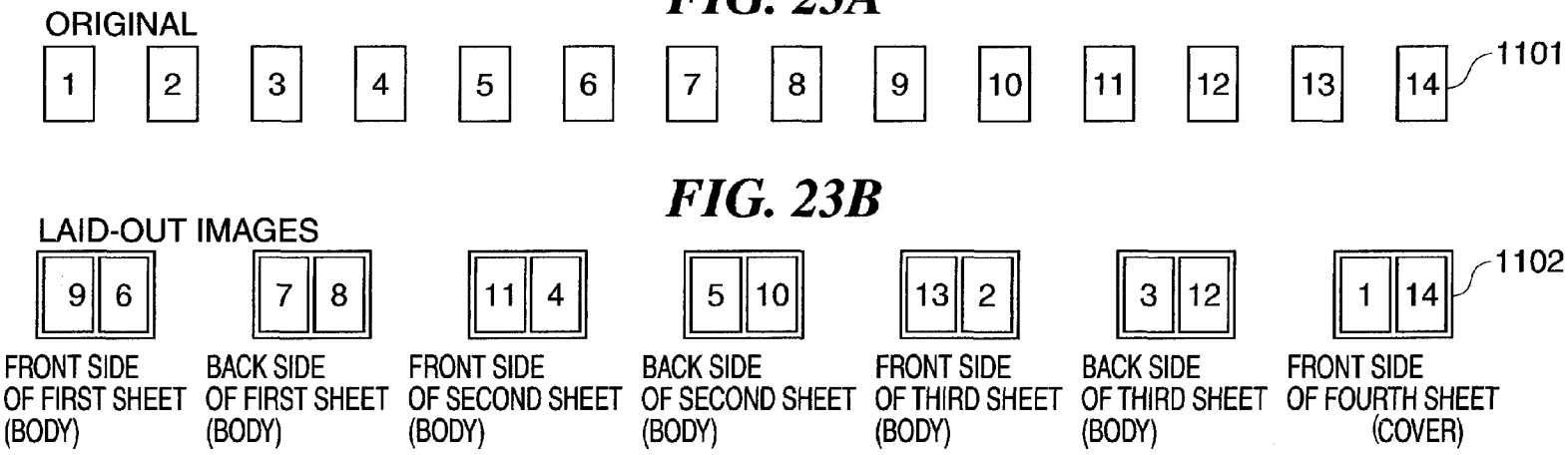
FIG. 23A
FIG. 23B
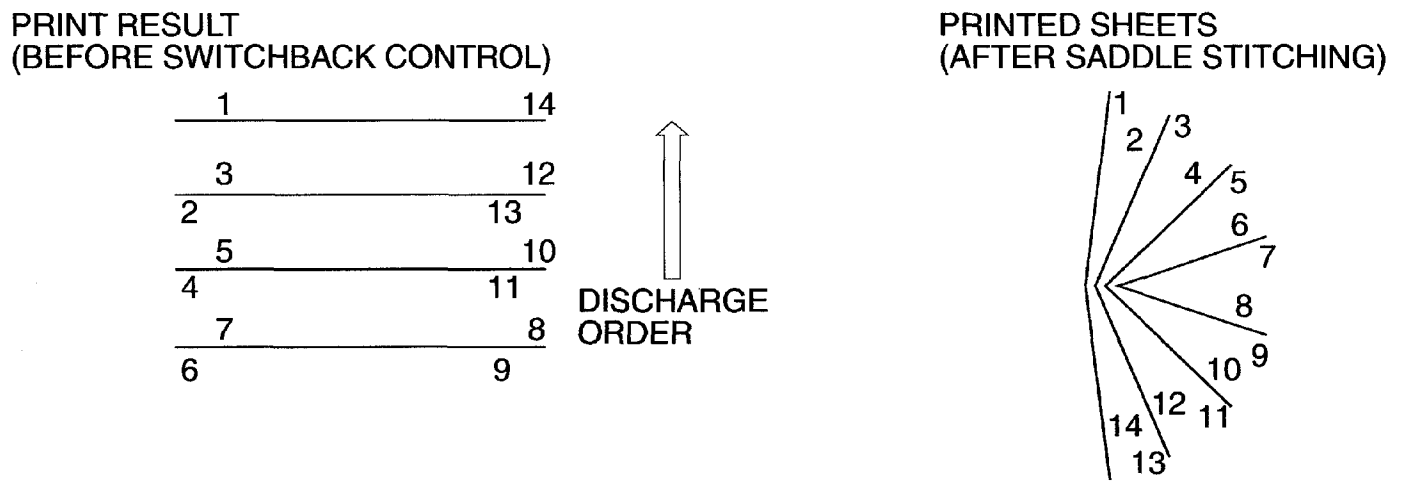
FIG. 23C
FIG. 23D

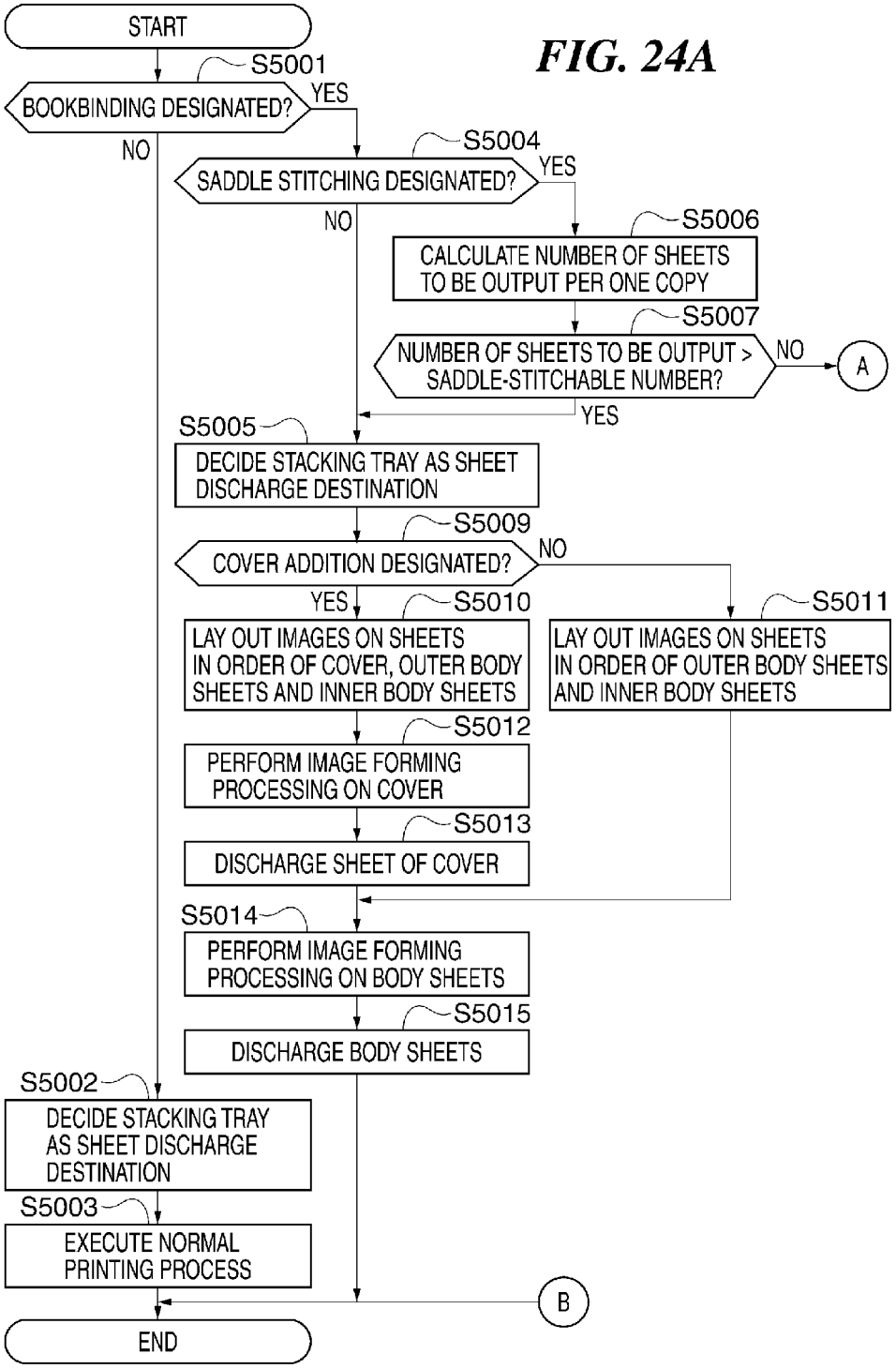
FIG. 24A
START
S5001
BOOKBINDING DESIGNATED?
YES
NO
S5004
SADDLE STITCHING DESIGNATED?
YES
NO
S5006
CALCULATE NUMBER OF SHEETS TO BE OUTPUT PER ONE COPY
S5007
NUMBER OF SHEETS TO BE OUTPUT > SADDLE-STITCHABLE NUMBER?
NO
A
YES
S5005
DECIDE STACKING TRAY AS SHEET DISCHARGE DESTINATION
S5009
COVER ADDITION DESIGNATED?
NO
YES
S5010
LAY OUT IMAGES ON SHEETS IN ORDER OF COVER, OUTER BODY SHEETS AND INNER BODY SHEETS
S5011
LAY OUT IMAGES ON SHEETS IN ORDER OF OUTER BODY SHEETS AND INNER BODY SHEETS
S5012
PERFORM IMAGE FORMING PROCESSING ON COVER
S5013
DISCHARGE SHEET OF COVER
S5014
PERFORM IMAGE FORMING PROCESSING ON BODY SHEETS
S5015
DISCHARGE BODY SHEETS
S5002
DECIDE STACKING TRAY AS SHEET DISCHARGE DESTINATION
S5003
EXECUTE NORMAL PRINTING PROCESS
B
END

PRINTING APPARATUS CAPABLE OF CONTROLLING ORDER OF IMAGE FORMATION ON A PLURALITY OF PAGES TO BE POST-PROCESSED, METHOD OF CONTROLLING THE PRINTING APPARATUS, AND STORAGE MEDIUM

BACKGROUND OF THE INVENTION

Field of the Invention

The present invention relates to a printing apparatus, a method of controlling the printing apparatus, and a storage medium, and more particularly to a printing apparatus to which a post-processing apparatus capable of performing a saddle-stitching process can be connected, a method of controlling the printing apparatus, and a storage medium.

Description of the Related Art

Conventionally, there has been known a post-processing apparatus that executes a saddle-stitching process for stitching (stapling) centers of a plurality of sheets, folding the stitched sheets into two, and outputs the sheets in the form of a brochure (see Japanese Patent Laid-Open Publication No. 2010-168134). In this post-processing apparatus, as shown in FIG. 25A, sheets conveyed from a printing apparatus (not shown) are discharged onto one of stacking trays 101 and 102 and a saddle-stitched product tray 103 according to a type of finishing process set by a user. For example, when no finishing process is to be executed, the sheets are discharged onto the stacking tray 101. When a normal stapling process is to be executed, the sheets are discharged onto the stacking tray 102, and when a saddle-stitching process is to be executed, the sheets are discharged onto the saddle-stitched product tray 103.

Further, in a saddle-stitching process section of the post-processing apparatus, there is a limit to the number of sheets which can be saddle-stitched due to restrictions on the apparatus. Conventionally, there has also been proposed an image processing apparatus that, when image data exceeding the limit of the number of sheets which can be saddle-stitched is input thereto, automatically changes a sheet discharge destination of a post-processing apparatus to thereby provide control such that the sheets are prevented from being conveyed to the saddle-stitching process section (see Japanese Patent Laid-Open Publication No. 2002-331730).

Further, in recent years, as shown in FIG. 25B, there has been proposed a post-processing apparatus that has attained downsizing of itself by using a common conveying path for executing a stapling process and for executing a saddle-stitching process. In this post-processing apparatus, in executing the saddle-stitching process, a sheet having entered the conveying path 104 for executing the stapling process is switched back by reverse rotation of a conveying roller pair 106, and is conveyed into a conveying path 105 for executing the saddle-stitching process. The post-processing apparatus employs a method of executing the saddle-stitching process on a plurality of sheets accumulated on an intermediate tray for executing the saddle-stitching process.

However, when a bookbinding process is executed using the post-processing apparatus shown in FIG. 25B, the saddle-stitching process is executed after switching back sheets having images printed thereon. Therefore, it is impossible to obtain a brochure in the correct page order if the order of image formation on sheets is the same as order of pages of the brochure.

Further, since a discharge destination of the sheets is different depending on whether or not the saddle-stitching process is designated, it is necessary to flexibly switch the order of image formation on the sheets during the bookbinding process according to the discharge destination. Therefore, when a sheet, such as thick paper having a large basis weight, which cannot be subjected to double-sided printing, is used as a cover of the brochure, the user is required to designate printing on the sheet while being conscious of whether an image is formed on a front side or a back side of the sheet, by taking a discharge destination of the sheet into account. This requires high-level operation skill of the user. Further, even if the user designates printing using his/her high-level operation skill, the user cannot always obtain a desired print product, because when image data is input which exceeds the limit of the number of sheets that can be saddle-stitched by the post-processing apparatus, the sheets are discharged onto a stacking tray which is not used for executing the saddle-stitching process.

SUMMARY OF THE INVENTION

The present invention provides a mechanism that makes it possible to output a saddle-stitched brochure in a correct page order when a post-processing apparatus that executes a saddle-stitching process by switching back a sheet is caused to execute the saddle-stitching process. Further, the present invention provides a mechanism that makes it possible to obtain products with the same image layout at different sheet discharge destinations when a bookbinding process is executed by a sheet post-processing apparatus which is capable of executing the saddle-stitching process.

In a first aspect of the present invention, there is provided printing apparatus comprising a conveying unit configured to convey sheets to a post-processing apparatus that is equipped with a stacking tray onto which a sheet is discharged from the printing apparatus, a saddle-stitched product tray onto which a brochure formed by executing a saddle-stitch bookbinding process on a plurality of sheets is discharged, a first conveying path along which the sheet discharged from the printing apparatus is conveyed to the stacking tray, and a second conveying path along which the sheets conveyed along the first conveying path are switched back to convey the sheets to the saddle-stitched product tray, a first determination unit configured to determine whether or not execution of the saddle-stitch bookbinding process is designated by print data input to the printing apparatus, a discharge destination decision unit configured, in a case where said first determination unit determines that execution of the saddle-stitch bookbinding process is designated, to decide a sheet discharge destination based on a number of sheets per one copy and a saddle-stitchable number of sheets capable of being saddle-stitched by the post-processing apparatus, a control unit configured to decide an order of image formation of pages of images to be printed on the plurality of sheets based on the sheet discharge destination decided by the discharge destination decision unit.

In a second aspect of the present invention, there is provided a printing apparatus comprising a conveying unit configured to convey sheets to a post-processing apparatus that is equipped with a stacking tray onto which a sheet is discharged from the printing apparatus, a saddle-stitched product tray onto which a brochure formed by executing a saddle-stitch bookbinding process on a plurality of sheets is discharged, a first conveying path along which the sheet discharged from the printing apparatus is conveyed to the stacking tray, and a second conveying path along which the sheets conveyed along the first conveying path are switched back to convey the sheets to the saddle-stitched product tray, a first determination unit configured to determine whether or not execution of the saddle-stitch bookbinding process is designated by print data input to the printing apparatus, a discharge destination decision unit configured, when the first determination unit determines that execution of the saddle-stitch bookbinding process is designated, to decide a sheet discharge destination based on a number of sheets per one copy and a saddle-stitchable number of sheets capable of being saddle-stitched by the post-processing apparatus, a first control unit configured, when the discharge destination decision unit decides that the discharge destination is the stacking tray, to control an order of image formation such that a sheet corresponding to an outermost sheet of the brochure is discharged first and a sheet corresponding to an innermost sheet of the brochure is discharged last, and a second control unit configured, when the discharge destination decision unit decides that the discharge destination is the saddle-stitched product tray, to control the order of image formation such that a sheet corresponding to an innermost sheet of the brochure is discharged first and a sheet corresponding to an outermost sheet of the brochure is discharged last.

According to the present invention, it is possible to output a saddle-stitched brochure in a correct page order when the post-processing apparatus that executes the saddle-stitching process by switching back a sheet is caused to execute the saddle-stitching process. Further, the order of image formation is controlled in order to switch the order of discharge of a sheet as an outer part of the brochure and a sheet as an inner part of the brochure, according to a sheet discharge destination of a sheet post-processing apparatus equipped with a switchback mechanism. Particularly when a sheet which cannot be subjected to double-sided printing is used as a cover of the brochure, the order of image formation is controlled in order to switch the order of discharge of a sheet corresponding to the cover of the brochure and sheets corresponding to a body of the brochure. This makes it possible for a user to obtain a brochure with the same image layout, even at different sheet discharge destinations of the sheet post-processing apparatus.

Further features of the present invention will become apparent from the following description of exemplary embodiments with reference to the attached drawings.

BRIEF DESCRIPTION OF THE DRAWINGS

FIGS. 23A to 23D are views useful in explaining a method for laying out images during the saddle-stitch bookbinding process when cover addition is set.

FIG. 24A is a flowchart of the bookbinding layout process executed by the printing apparatus.

DESCRIPTION OF THE EMBODIMENTS

The present invention will now be described in detail below with reference to the accompanying drawings showing embodiments thereof.

Figure 1:
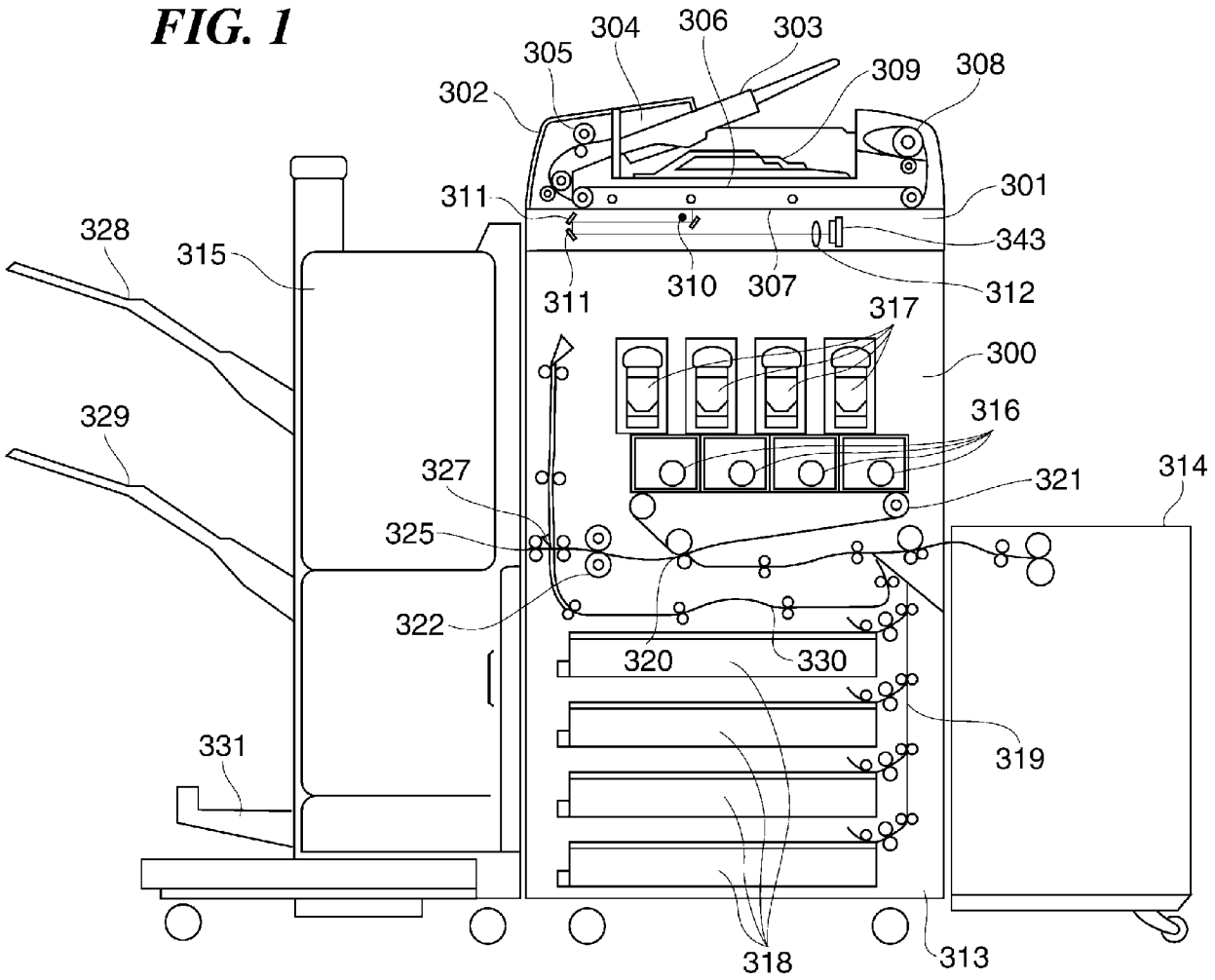
FIG. 1 is a schematic view of a printing apparatus according to an embodiment of the present invention.

FIG. 1 is a schematic view of a printing apparatus according to an embodiment of the present invention. In the present embodiment, a multifunction peripheral equipped with various functions, such as a copy function, a print function, and a facsimile function, will be described as the printing apparatus, by way of example. However, the printing apparatus may be a single-function apparatus.

Referring to FIG. 1, the printing apparatus, denoted by reference numeral 300, comprises a scanner section 301, a document feeder (DF) 302, and a printer section 313 provided with four color drums, and is connected to a sheet feed deck 314 and a finisher (sheet post-processing apparatus) 315, both of which are configured to be capable of being connected to the printing apparatus 300.

First, a description will be given of a reading operation mainly executed by the scanner section 301.

When performing an original reading operation by setting an original on an original platen glass 307, a user closes the document feeder 302 after setting the original on the original platen glass 307. When an opening and closing sensor (not shown) detects closing of the document feeder 302, a reflection-type original size detection sensor (not shown) disposed in a housing of the scanner section 301 detects the size of the set original. When the original size has been detected, a light source 310 illuminates the original, and light emitted from the light source 310 and reflected from the original enters a CCD (charge coupled device) 343 via a reflection plate 311 and a lens 312. The CCD 343 converts the incident light to a digital signal, and delivers the digital signal to a controller (not shown) of the scanner section 301. The controller performs desired image processing on the digital signal to convert the same to a recording signal, and stores the recording signal as image data in a memory.

When performing an original reading operation by setting an original on the document feeder 302, the user places the original face-up on a tray of a document setting section 303 of the document feeder 302. When the original is placed, an original presence/absence detection sensor 304 detects that the original has been set. When the original presence/absence detection sensor 304 detects that the original has been set, the controller rotates an original feed roller 305 and a conveying belt 306 to convey the original to a predetermined position on the original platen glass 307. After conveying the original to the predetermined position, the controller performs the same original reading operation as the original reading operation executed by setting the original on the original platen glass 307, and stores image data produced by the reading operation, in the memory. Then, the controller discharges the original having been subjected to the reading operation onto an original discharge tray 309 via a conveying roller 308.

In a case where there are a plurality of originals set on the document feeder 302, simultaneously when discharging an original having been subjected to the reading operation, the controller feeds a next original via the original feed roller 305, and performs a reading operation of the next original. Thus, the controller performs reading operations of the originals.

Next, a description will be given of a printing operation executed by the printer section 313.

The record signal (print image data) temporarily stored in the memory of the controller is transferred to the printer section 313, and is converted to recording laser lights for the four colors of yellow, magenta, cyan, and black by a laser recording section (not shown). The recording laser lights are irradiated onto photosensitive members 316 of the respective colors, whereby electrostatic latent images are formed on the respective photosensitive members 316. Then, toner development is performed on the electrostatic latent images by toner supplied from toner cartridges 317 of the respective colors, and thus visualized images are primarily transferred from the photosensitive members 316 onto an intermediate transfer belt 321 to thereby form a toner image on the intermediate transfer belt 321. The intermediate transfer belt 321 is rotated clockwise, and when a sheet fed from one of sheet feeding cassettes 318 or the sheet feed deck 314 via a sheet conveying path 319 reaches a secondary transfer position 320, the toner image is transferred from the intermediate transfer belt 321 onto the sheet. The sheet having the toner image transferred thereon is subjected to processing for fixing the toner image on the sheet by pressure and heat by a fixing device 322. Then, the sheet is conveyed along a discharge conveying path, and is discharged from a discharge outlet 325 into the finisher 315.

In double-sided printing, after the sheet has passed the fixing device 322, the conveying path is switched by a flapper 327, and the sheet is switched back such that it is conveyed downward. Then, the sheet is conveyed via a double-sided printing sheet conveying path 330 to the secondary transfer position 320 again, whereby double-sided printing operation is achieved.

Next, a description will be given of an operation executed by the finisher 315.

The finisher 315 performs post-processing on a sheet according to user's settings. Specifically, the finisher 315 has functions of stapling (one-point stapling and two-point stapling), punching (two-hole punching, three-hole punching, and four-hole punching), saddle stitching, and so forth.

The finisher 315 includes stacking trays 328 and 329. Sheets discharged into the finisher 315 via the discharge outlet 325 are sorted to discharge destinations according to the user's settings in association with functions of copy, print, and facsimile. For example, when the multifunction peripheral is used as a printer, it is possible to configure, using a driver printer, various settings of monochrome/color printing, sheet size, 2-up/4-up/N-up printing, double-sided printing, stapling, punching, saddle stitching, interleaved sheets, front cover, back cover, etc.

Next, the arrangement and operation of the finisher 315 will be described with reference to FIGS. 2 to 7.

Figure 2:
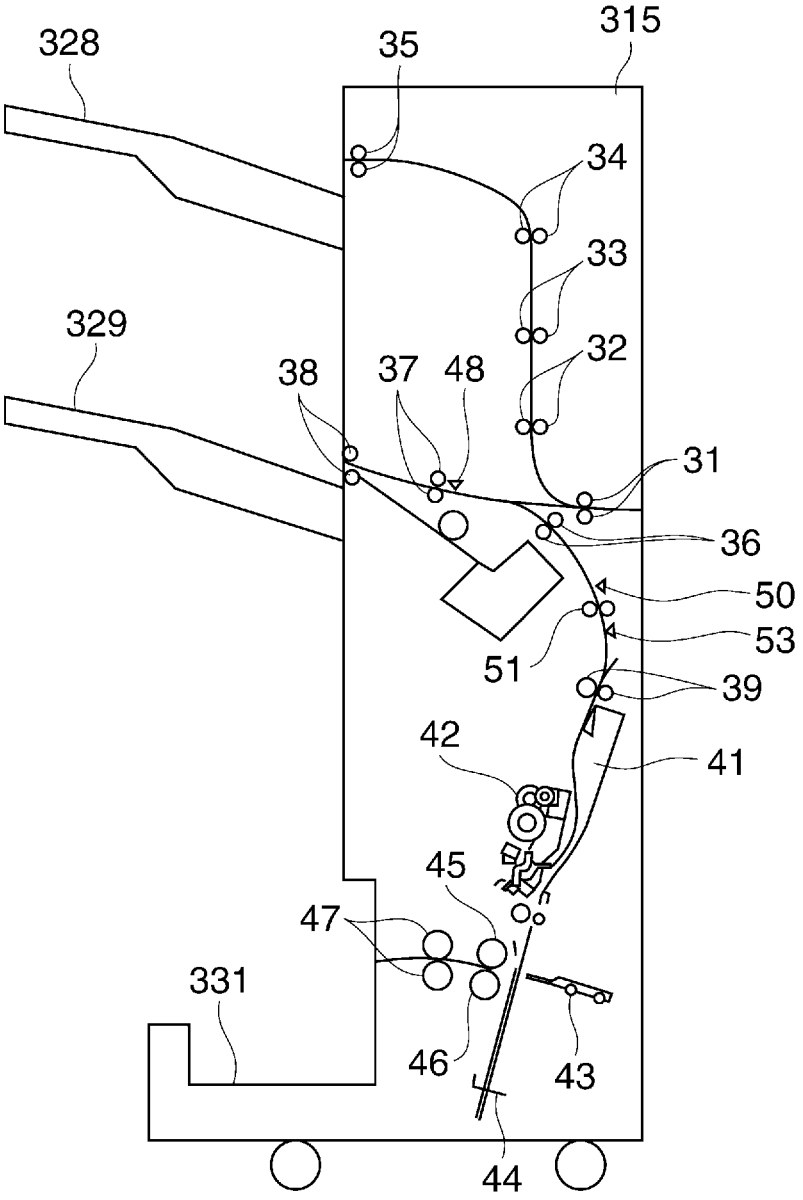
FIG. 2 is a schematic view of a finisher.

Referring to FIG. 2, the finisher 315 comprises conveying roller pairs 31 to 39, leading-edge detection sensors 50 and 53, a trailing-edge detection sensor 48, a stapler 42, a thrust plate 43, a stopper 44, folding rollers 45 and 46, and a bundle conveyance roller pair 47. The finisher 315 may be configured to be operated by commands from a controller of the printing apparatus 300 or may be configured to be operated by its own controller.

A sheet conveyed from the printing apparatus 300 is discharged onto one of the stacking trays 328 and 329 and a saddle-stitched product tray 331 according to a type of a finishing process set by the user. For example, when no finishing process is to be executed, the sheet is discharged onto the stacking tray 328. When a normal stapling process is to be executed, the sheet is discharged onto the stacking tray 329, whereas when a saddle-stitching process, described hereinafter, is to be executed, the sheet is discharged onto the saddle-stitched product tray 331. A conveying path from a sheet inlet of the finisher 315 to each of the stacking trays 328 and 329 corresponds to a first conveying path.

Figure 3:
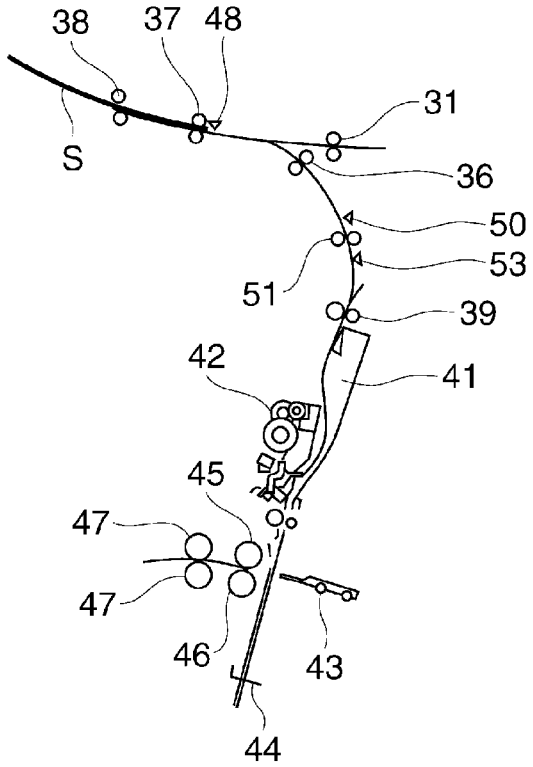
FIG. 3 is a schematic partial view of the finisher in a state where a trailing edge of a sheet is detected by a trailing-edge detection sensor.

The sheet conveyed from the printing apparatus 300 is conveyed by the conveying roller pairs 31, 37 and 38 until the trailing edge of the sheet reaches the trailing-edge detection sensor 48. Then, when the trailing edge of the sheet is detected by the trailing-edge detection sensor 48, the conveying roller pairs 37 and 38 nipping the sheet are stopped (FIG. 3).

Figure 4:
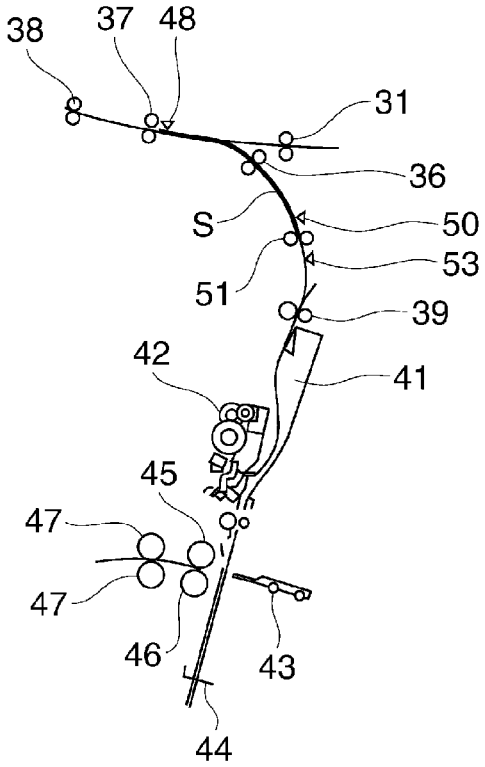
FIG. 4 is a schematic partial view of the finisher in a state where a leading end of the sheet is brought into abutment with a nip of a skew correction roller pair.

Next, the sheet is switched back by reverse rotation of the conveying roller pairs 37 and 38, and is conveyed by the conveying roller pair 36 until the leading edge of the sheet reaches the leading-edge detection sensor 50. When the leading edge of the sheet is detected by the leading-edge detection sensor 50, the conveying roller pair 36 nipping the sheet is decelerated, and the leading edge of the sheet is brought into abutment with a nip of a skew correction roller pair 51 (FIG. 4).

The conveying roller pair 36 continues to rotate for some time even after the leading edge of the sheet has been brought into abutment with the nip of the skew correction roller pair 51. The conveying roller pair 36 stops after the sheet has formed a loop in a loop space.

Figure 5:
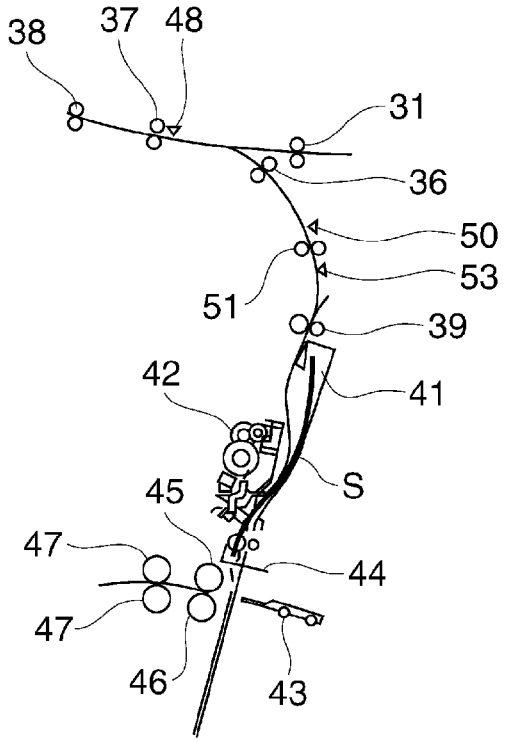
FIG. 5 is a schematic partial view of the finisher in a state where the leading end of the sheet is brought into abutment with a stopper.

Next, the skew correction roller pair 51 starts to rotate. If the sheet is skewed, the skew of the sheet is corrected by the skew correction roller pair 51, whereafter the sheet is conveyed toward the conveying roller pair 39. When the leading edge of the sheet is detected by the leading-edge detection sensor 53, the sheet is conveyed by a predetermined amount after the time point of the detection, and the leading edge of the sheet is brought into abutment with the stopper 44 (FIG. 5). At this time, as shown in FIG. 5, the sheet is positioned by the stopper 44 such that a stapling position where stapling is to be executed by the stapler 42 is located at a central portion of the sheet.

Figure 6:
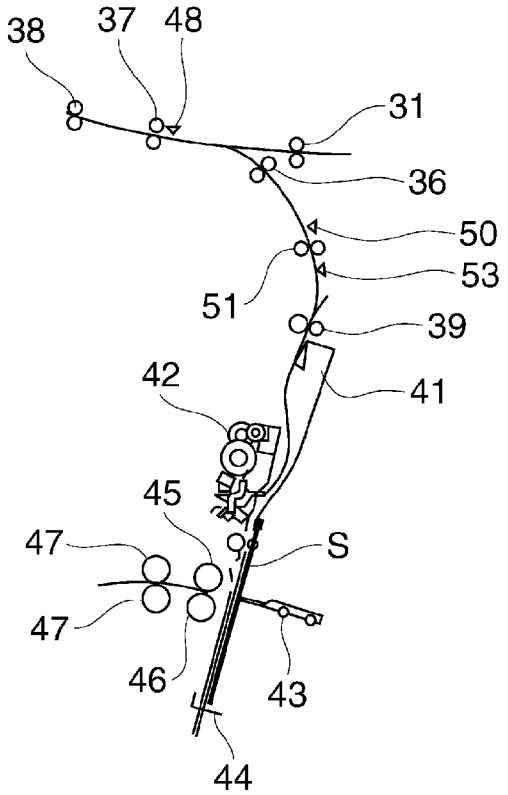
FIG. 6 is a schematic partial view of the finisher in a state where a sheet bundle is being moved downstream in a sheet conveying direction.

The above-described operation is repeatedly performed, whereby a plurality of sheets are sequentially conveyed into a conveying path 41 (accumulation tray). When all the sheets for forming a brochure are conveyed into the conveying path 41 (accumulation tray), positions of the sheets in a sheet width direction are aligned using a sheet-width-direction alignment plate (not shown) to form a sheet bundle in the conveying path 41. In doing this, the sheets conveyed into the conveying path 41 (accumulation tray) are sequentially conveyed in an order starting from a sheet corresponding to an innermost one of a body of the brochure and ending in a sheet corresponding to a cover of the brochure. In a case where the saddle-stitching process is set to be performed, the stapler 42 staples the sheet bundle, and after the sheet bundle is stapled by the stapler 42, the stopper 44 holding the sheet bundle is moved downstream in the sheet conveying direction. This causes the sheet bundle to move downstream in the sheet conveying direction (FIG. 6).

Figure 7:
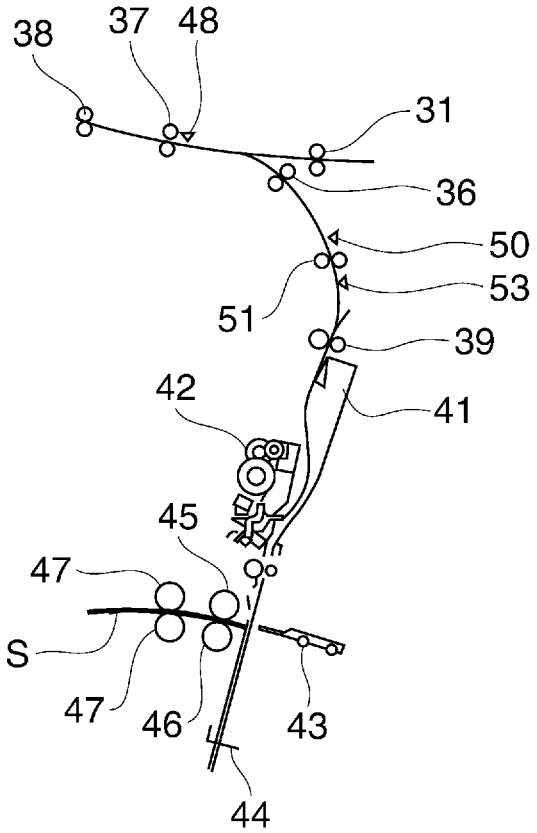
FIG. 7 is a schematic partial view of the finisher in a state where the sheet bundle is being discharged onto a saddle-stitched product tray by a bundle conveyance roller pair.

The stopper 44 positions the sheet bundle such that a central portion of the sheet bundle is brought to the position of the thrust plate 43. Then, a front end of the thrust plate 43 is brought into abutment with a portion of the sheet bundle positioned by the stopper 44, at which a fold line is to be formed, and the sheet bundle is pushed into the nips of the folding rollers 45 and 46, whereby the fold line is formed on the sheet bundle. The sheet bundle with the fold line thus formed by the folding rollers 45 and 46 is discharged onto the saddle-stitched product tray 331 by the bundle conveyance roller pair (FIG. 7).

Next, a controller for controlling the scanner section 301, the printer section 313, and a network interface (I/F) section of the printing apparatus 300 will be described with reference to FIG. 8.

Figure 8:
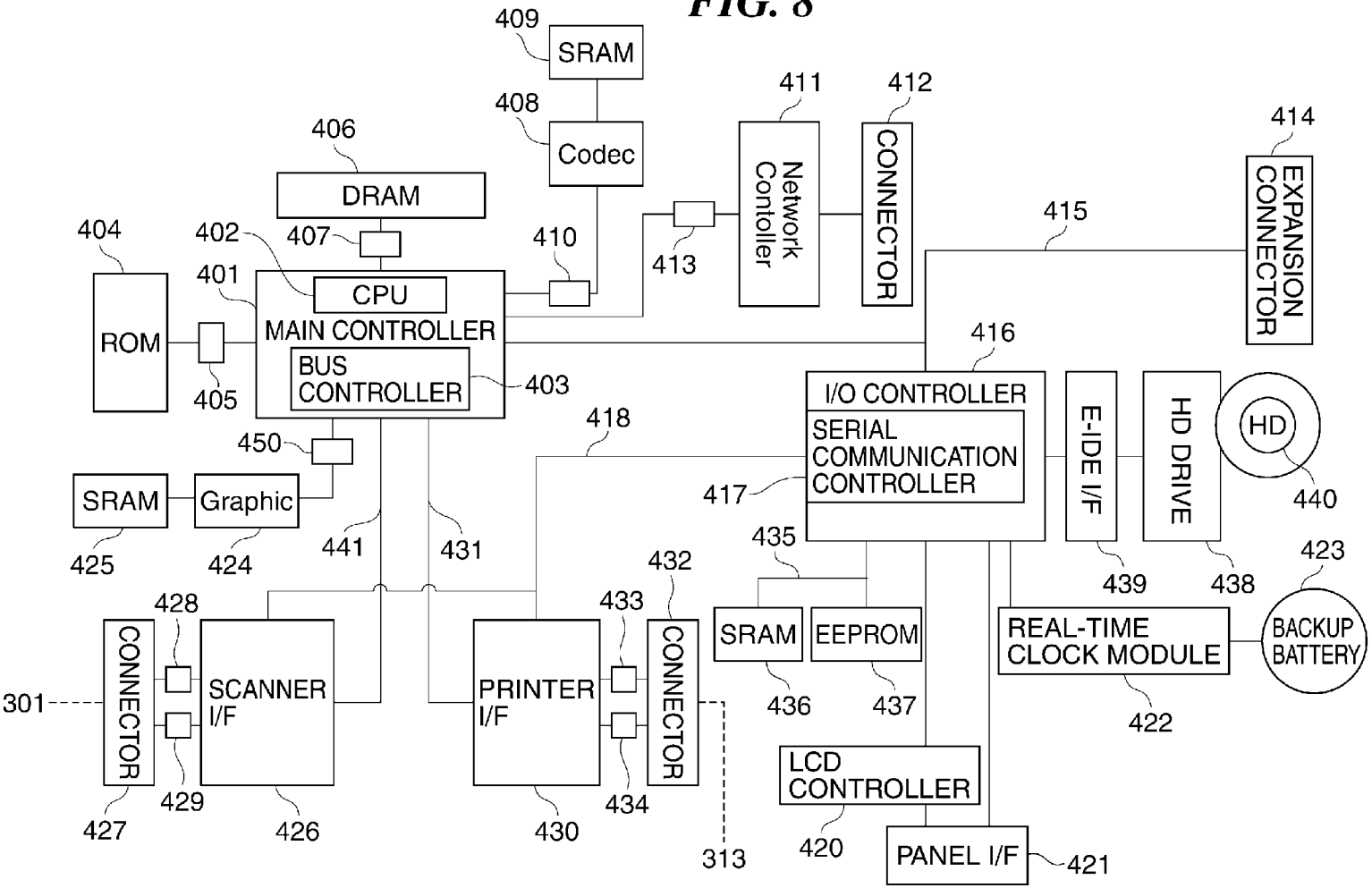
FIG. 8 is a functional block diagram of a controller of the printing apparatus.

FIG. 8 is a functional block diagram of the controller of the printing apparatus 300.

A main controller 401 mainly comprises a CPU 402, a bus controller 403, and various interface controller circuits. The CPU 402 and the bus controller 403 control the overall operation of the printing apparatus. The CPU 402 operates based on a program read from a ROM 404 via a ROM interface 405. This program also describes an operation for interpreting PDL (page description language) code data received from an external PC and rasterizing the same into raster image data. In short, the operation is executed by software. The bus controller 403 controls transfer of data input to and output from respective associated interfaces by performing control of bus arbitration and DMA data transfer.

A DRAM 406 is connected to the main controller 401 via a DRAM interface 407, and is used as a work area which the CPU 402 uses to operate and an area for accumulating image data.

A CODEC (coder/decoder) 408 compresses raster image data accumulated in the DRAM 406 by one of compression methods including MH, MR, MMR, JBIG, and JPEG. Inversely, the CODEC 408 decompresses compressed and accumulated code data into raster image data.

A SRAM (static RAM) 409 is used as a temporary work area by the CODEC 408. The CODEC 408 is connected to the main controller 401 via an interface 410. Data transfer between the CODEC 408 and the DRAM 406 is controlled by the bus controller 403, whereby DMA (direct memory access) transfer of data is executed.

A graphic processor 424 performs processing, such as image rotation, image magnification, color space conversion, or binarization, on raster image data accumulated in the DRAM 406.

A SRAM 425 is used as a temporary work area by the graphic processor 424. The graphic processor 424 is connected to the main controller 401 via a graphic processor interface 450. DMA transfer between the graphic processor 424 and the DRAM 406 is controlled by the bus controller 403, whereby DMA transfer of data is executed.

A network controller 411 is connected to the main controller 401 via a network interface 413. Further, the network controller 411 is connected to an external network via a connector 412. As the network, there may be mentioned an Ethernet (registered trademark) as a general one. Receipt of print data from an external PC is controlled by the network controller 411, and the print data is sent to the CPU 402. The CPU 402 stores the sent print data in the DRAM 406 or a HD (hard disk) 440, and processes the same.

A general-purpose high-speed bus 415 connects between an expansion connector 414 and an I/O controller 416. In the present embodiment, transmission and reception of commands between the printing apparatus 300 and the finisher 315 is performed via the general-purpose high-speed bus 415. The I/O controller 416 is provided with a two-channel start-stop synchronization serial communication controller 417 for exchanging control commands with CPUs of the scanner section 301 and the printer section 313. The I/O controller 416 is connected to a scanner interface 426 and a printer interface 430 via an I/O bus 418.

Figure 9:
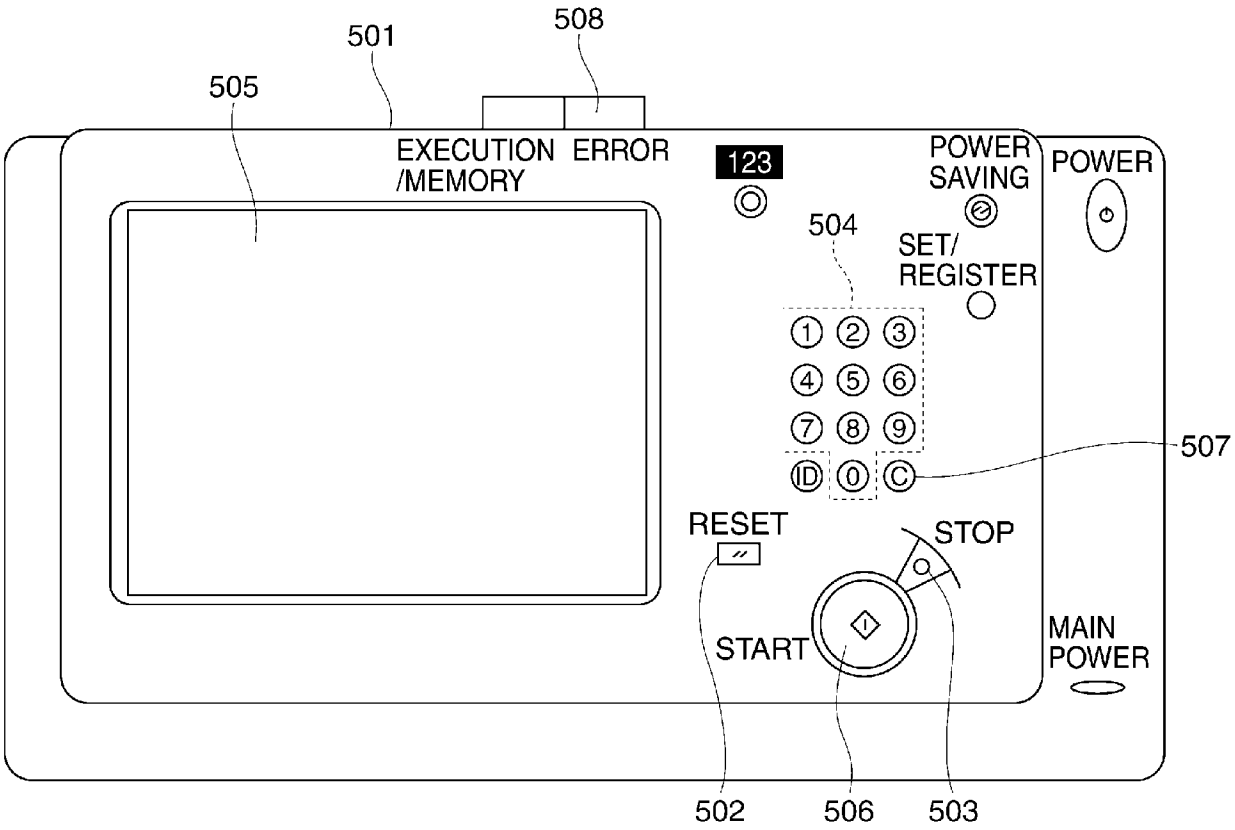
FIG. 9 is a view of the appearance of a console section of the printing apparatus.

A panel interface 421 is connected to an LCD controller 420, and comprises a display interface for performing display on a liquid crystal display screen of a console section 501, shown in FIG. 9, and a key input interface for input from hard keys or touch panel keys.

Referring to FIG. 9, the console section 501 comprises a liquid crystal display section, a touch panel input device mounted on the liquid crystal display section, and a plurality of hard keys. Signals input from a touch panel or the hard keys are transmitted to the CPU 402 via the above-mentioned panel interface 421. The liquid crystal display section displays image data sent from the panel interface 421. The liquid crystal display section displays functions for operation of the printing apparatus, image data, and the like. The console section 501 will be described in further detail hereinafter.

A real-time clock module 422 is used for updating and storing the date and time managed by the printing apparatus 300, and is backed up by a backup battery 423.

An E-IDE interface 439 is used for connecting the printing apparatus 300 to an external storage device. In the present embodiment, the CPU 402 connects to a hard disk drive (HD drive) 438 via the E-IDE interface 439, and causes the hard disk drive 438 to store image data in the HD 440 and read image data from the HD 440. Connectors 427 and 432 are connected to the scanner section 301 and the printer section 313, respectively. The connector 427 is connected to the scanner interface 426 via a synchronous serial interface 428 and a video interface 429, and the connector 432 is connected to the printer interface 430 via a synchronous serial interface 433 and a video interface 434.

The scanner interface 426 is connected to the main controller 401 via a scanner bus 441. The scanner interface 426 has a function of performing predetermined processing on image data received from the scanner section 301. Further, the scanner interface 426 also has a function of outputting to the video interface 429 a control signal generated based on a video control signal sent from the scanner section 301. Data transfer from the scanner bus 441 to the DRAM 406 is controlled by the bus controller 403.

The printer interface 430 is connected to the main controller 401 via a printing apparatus bus 431. The printer interface 430 has a function of performing predetermined processing on image data output from the main controller 401 and outputting the processed image data to the printer section 313. Further, the printer interface 430 also has a function of outputting to the printing apparatus bus 431 a control signal generated based on a video control signal sent from the printer section 313. Transfer of raster image data loaded in the DRAM 406 to the printer section 313 is controlled by the bus controller 403. The raster image data is DMA-transferred to the printer section 313 via the printing apparatus bus 431 and the video interface 434.

A SRAM 436 is a memory which is capable of storing data by electric power supplied from the backup battery 423 even after the whole printing apparatus is powered off. The SRAM 436 is connected to the I/O controller 416 via a bus 435. Similarly, an EEPROM 437 is a memory connected to the I/O controller 416 via the bus 435.

Next, the console section 501 will be described with reference to FIG. 9.

The user configures various print settings via the console section 501. A reset key 502 is used to cancel settings or the like configured by the user. A stop key 503 is used to stop a job in operation. Ten keys 504 are used to perform entry of e.g. numerical values for setting.

A display section 505 has the above-mentioned touch panel and liquid crystal display section integrally formed with each other. The display section 505 displays various screens on the liquid crystal display section based on instructions from the CPU 402, and receives instructions from the user via the touch panel.

A start key 506 is used for starting a job, such as reading of an original. A clear key 507 is used for clearing a setting or the like. A lamp 508 notifies the user of a state of the printing apparatus 300 or the finisher 315 by being lighted when a job is being executed or when an error has occurred in the printing apparatus 300 or the finisher 315.

Next, the screens displayed on the display section 505 of the console section 501 will be described with reference to FIGS. 10 to 17.

Figure 10:
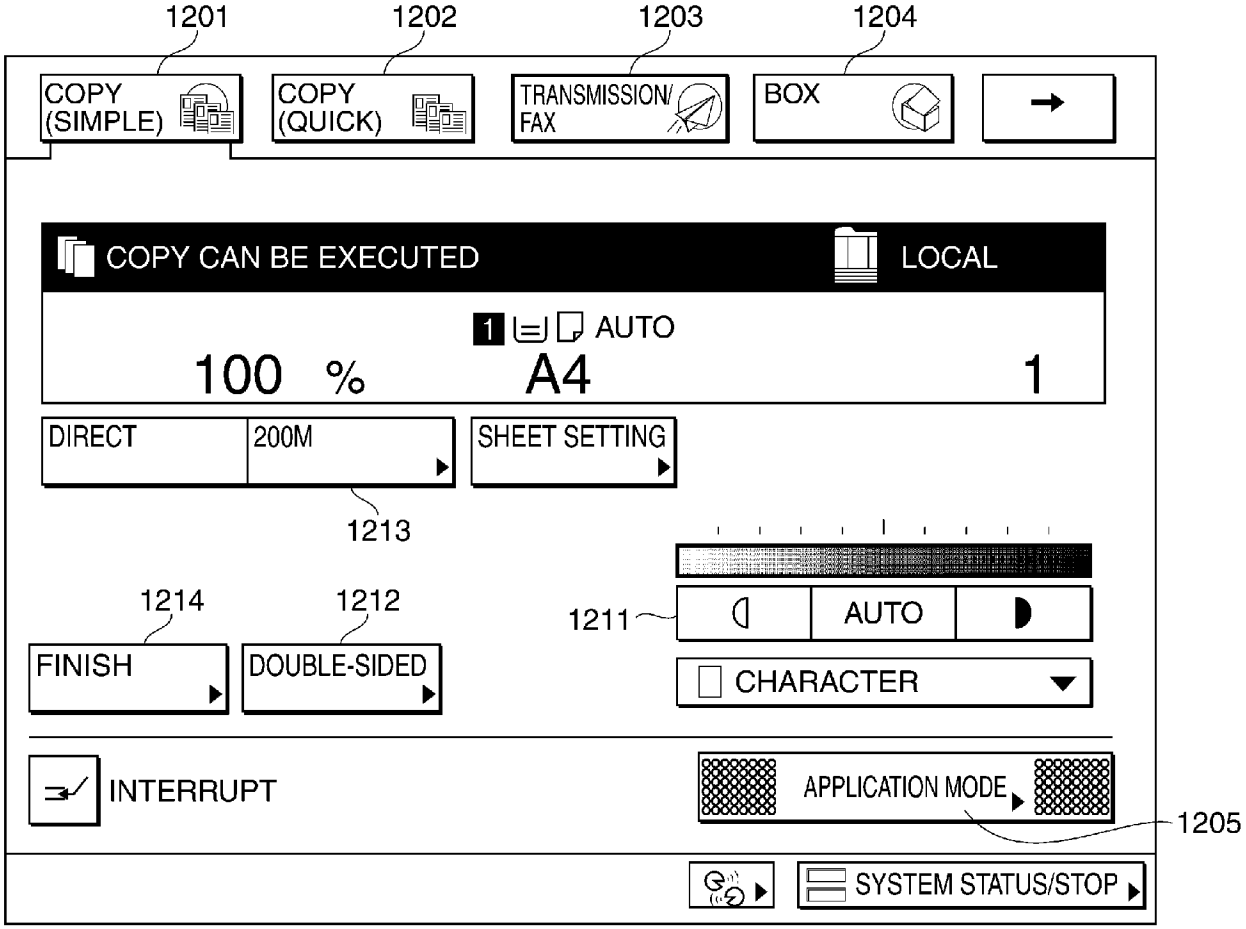
FIG. 10 is a view of an example of a standard screen displayed on a display section of the console section.

FIG. 10 shows an example of a standard screen displayed on the display section 505.

Tabs 1201 to 1204 displayed in an upper portion of the screen are used to select functions executable by the printing apparatus. They indicate a copy function (simple), a copy function (quick), a transmission/facsimile function, and a box function, sequentially from the left as viewed in FIG. 10.

The copy function (simple) and the copy function (quick) are provided for printing original image data read by the scanner section 301, using the printer section 313, and performing finishing processes, such as stapling and saddle stitching, as required. The user can configure settings of the copy function in a state where the copy function (simple) or the copy function (quick) is selected. Note that the copy function (quick) is capable of performing a larger number of settings than the copy function (simple) on one screen.

The transmission/facsimile function is a transmission function e.g. for facsimile transmission, E-mail transmission, and transmission of data to a file server. The box function is a function for storing image data read by the scanner section 301 in the HD 440 or a function for manipulating or printing data stored in the HD 440.

When each tab of the above-described functions is selected, there is displayed an associated screen on which detailed settings of the selected function can be configured.

The screen illustrated in FIG. 10 is a copy-setting screen displayed in a state where the copy function (simple) has been selected, and is used for receiving various copy settings from the user. The copy setting screen illustrated in FIG. 10 displays a button 1211 for selecting between color copy, monochrome copy, or automatic copy, a button 1212 for designating single-sided copying or double-sided copying, a button 1213 for designating a copy magnification, and buttons for performing finishing processes. Two buttons are displayed as the buttons for performing finishing processes. One is a "finish" button 1214. The "finish" button 1214 is used for displaying a screen which receives settings for executing a stapling process for stapling the ends of sheets by a stapler. The other is an "application mode" button 1205. The "application mode" button 1205 is used for displaying a screen which receives settings for executing a finishing process, such as saddle stitching by the finisher 315 connected to the printing apparatus 300.

When the user desires to obtain a brochure by a bookbinding process, the user configures settings for causing the printing apparatus 300 and the finisher 315 to execute the bookbinding process, via screens illustrated in FIGS. 10 to 17. When the user configures the settings for causing the bookbinding process to be executed, the printing apparatus generates an image in which pages to be printed are laid out based on the settings, and executes printing based on the generated image. The finisher 315 performs an appropriate finishing process based on the settings.

Figure 11:
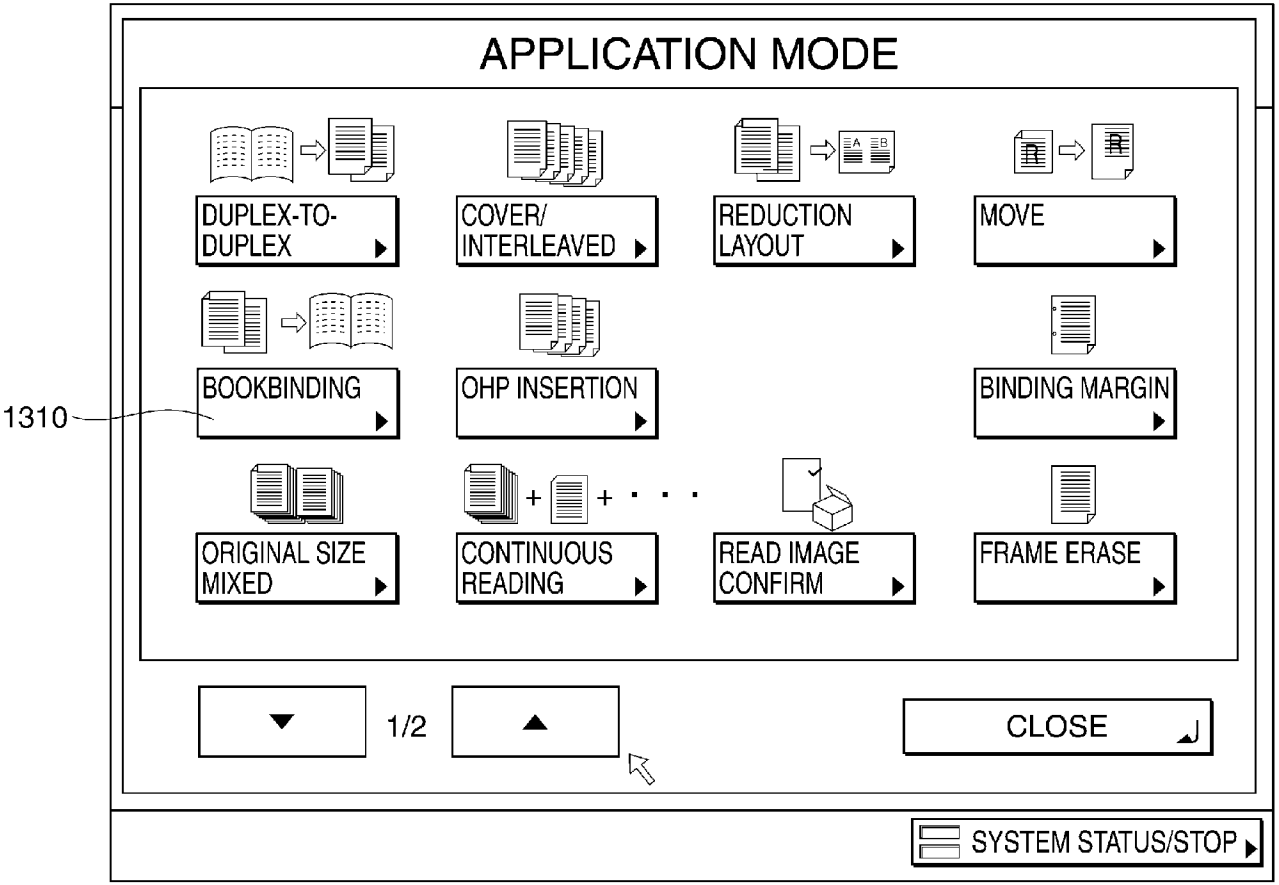
FIG. 11 is a view of an example of an application mode configuration screen displayed on the display section.
Figure 12:
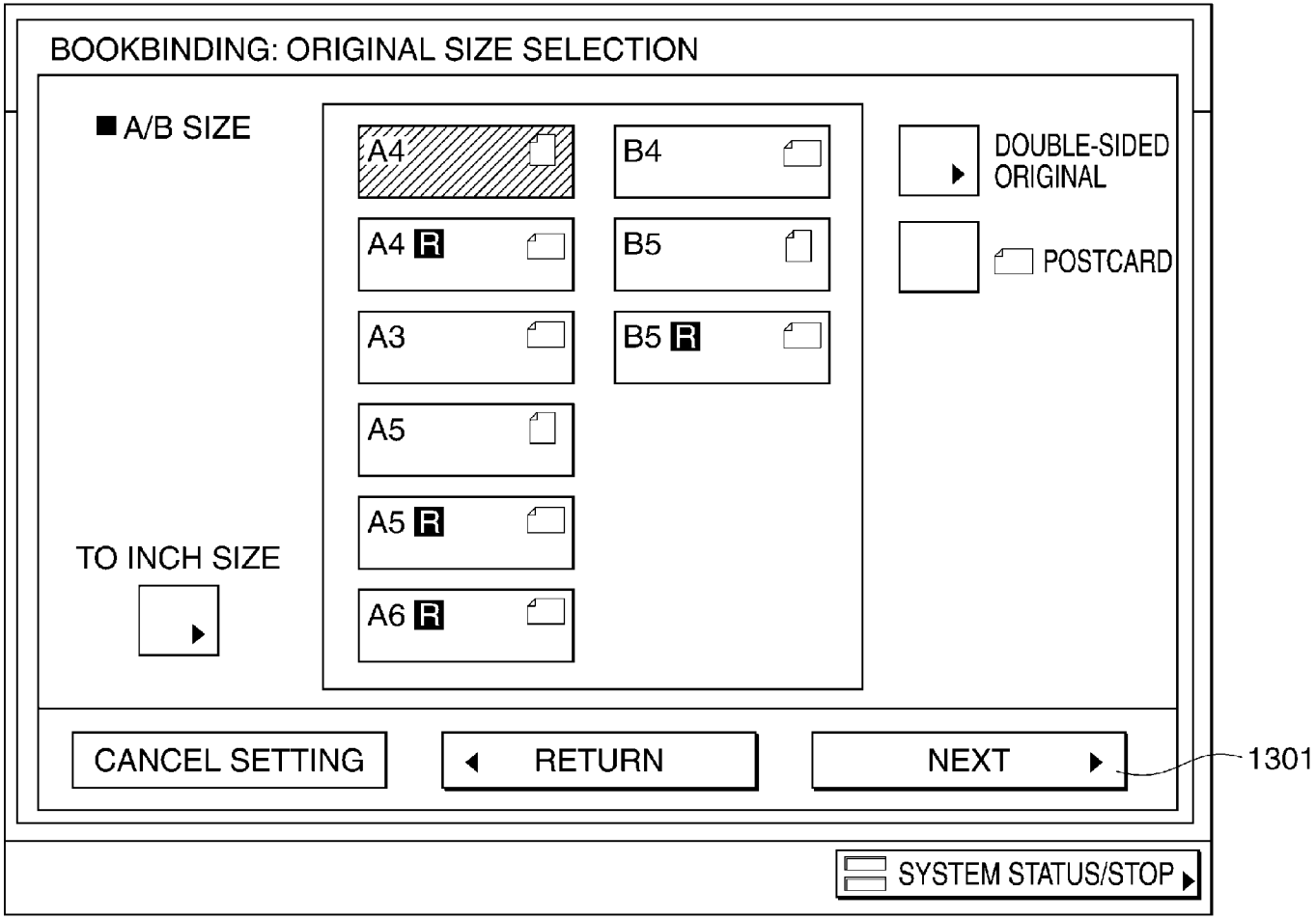
FIG. 12 is a view of an example of an original size selection screen for bookbinding, displayed on the display section.
Figure 13:
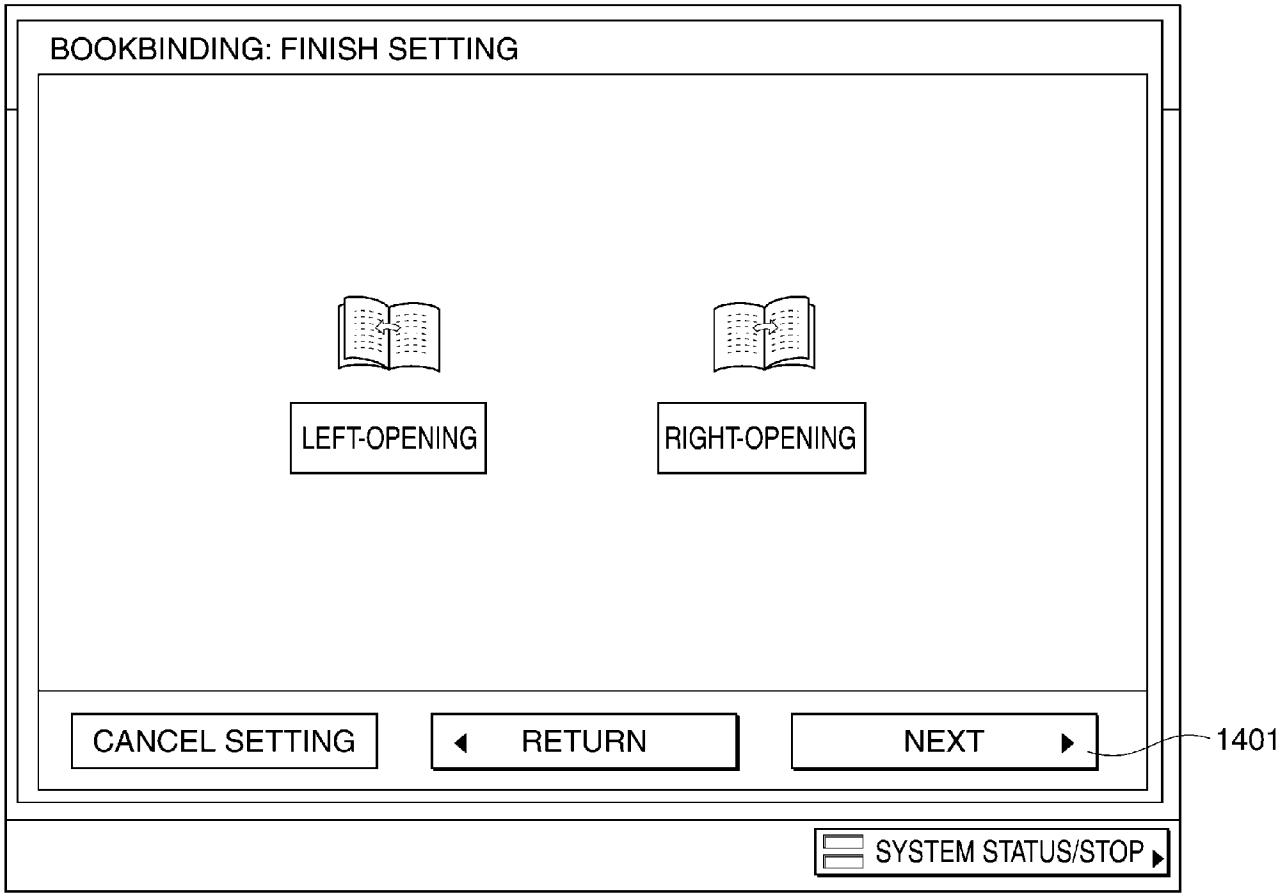
FIG. 13 is a view of an example of a finish configuration screen for bookbinding, displayed on the display section.
Figure 14:
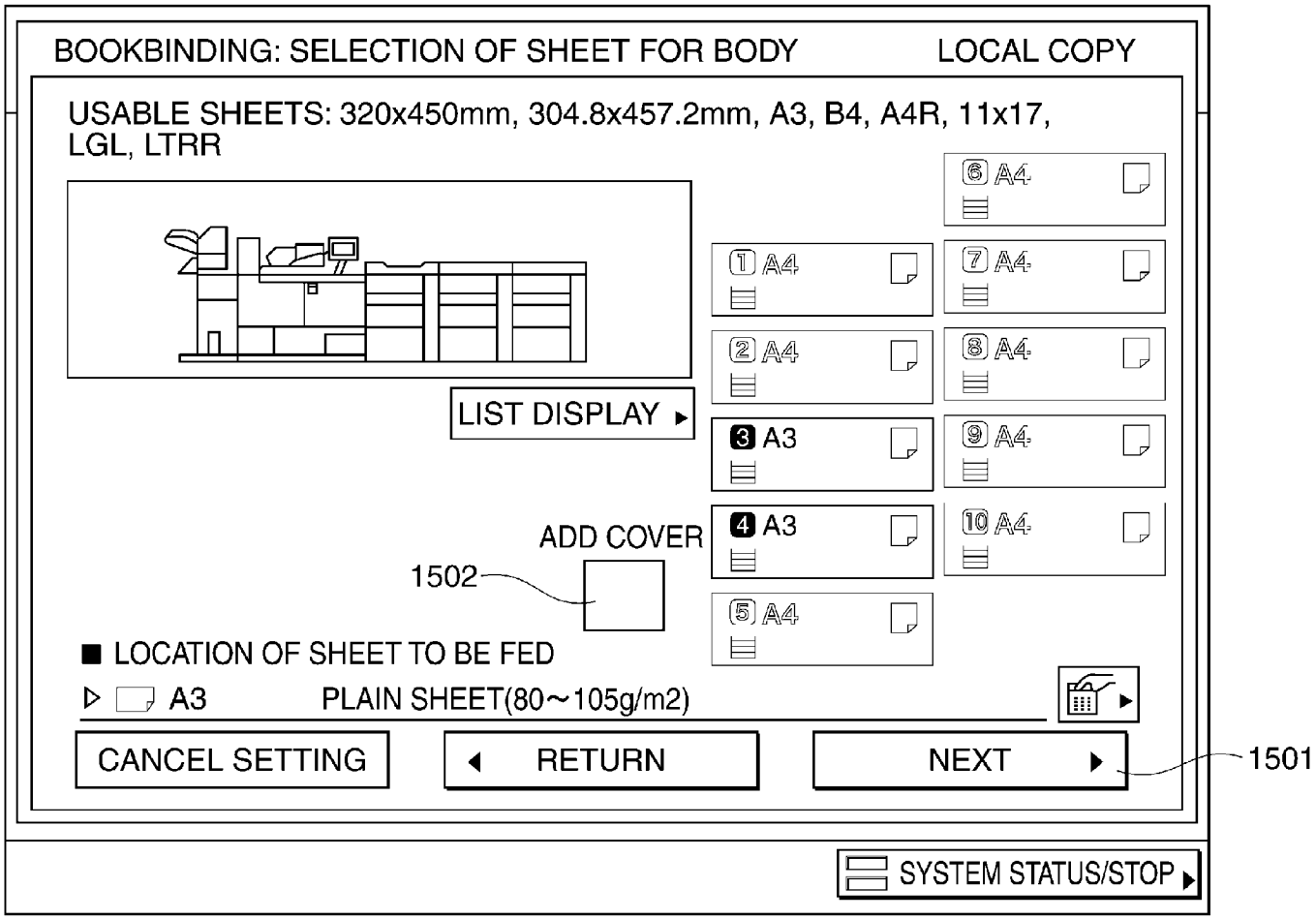
FIG. 14 is a view of an example of a body sheet selection screen for bookbinding, displayed on the display section.

First, the user presses the "application mode" button 1205 on the screen illustrated in FIG. 10. When the user presses the "application mode" button 1205, a screen illustrated in FIG. 11 is displayed on the console section 501. Next, when the user presses a "bookbinding" button 1310 on the screen illustrated in FIG. 11, a screen for configuring settings of the bookbinding process, as illustrated in FIG. 12, is displayed. The user designates the size of an original to be read by the scanner section 301 on the screen shown in FIG. 12. In the example illustrated in FIG. 12, an A4-size is designated as the size of the original. Then, when the user presses a "next" button 1301 appearing in FIG. 12, a screen shown in FIG. 13 is displayed. The user sets whether to form the brochure as a left-opening type (left-bound type) or as a right-opening type (right-bound type), via the screen shown in FIG. 13. Next, when the user presses a "next" button 1401 on the screen shown in FIG. 13, a screen illustrated in FIG. 14 is displayed. The user selects a sheet size of the body of the brochure on the screen illustrated in FIG. 14. Further, the user can also set whether or not a cover is to be added to the brochure, via the screen appearing in FIG. 14. A function for adding a cover to the brochure will be described in detail hereinafter.

Figure 15:
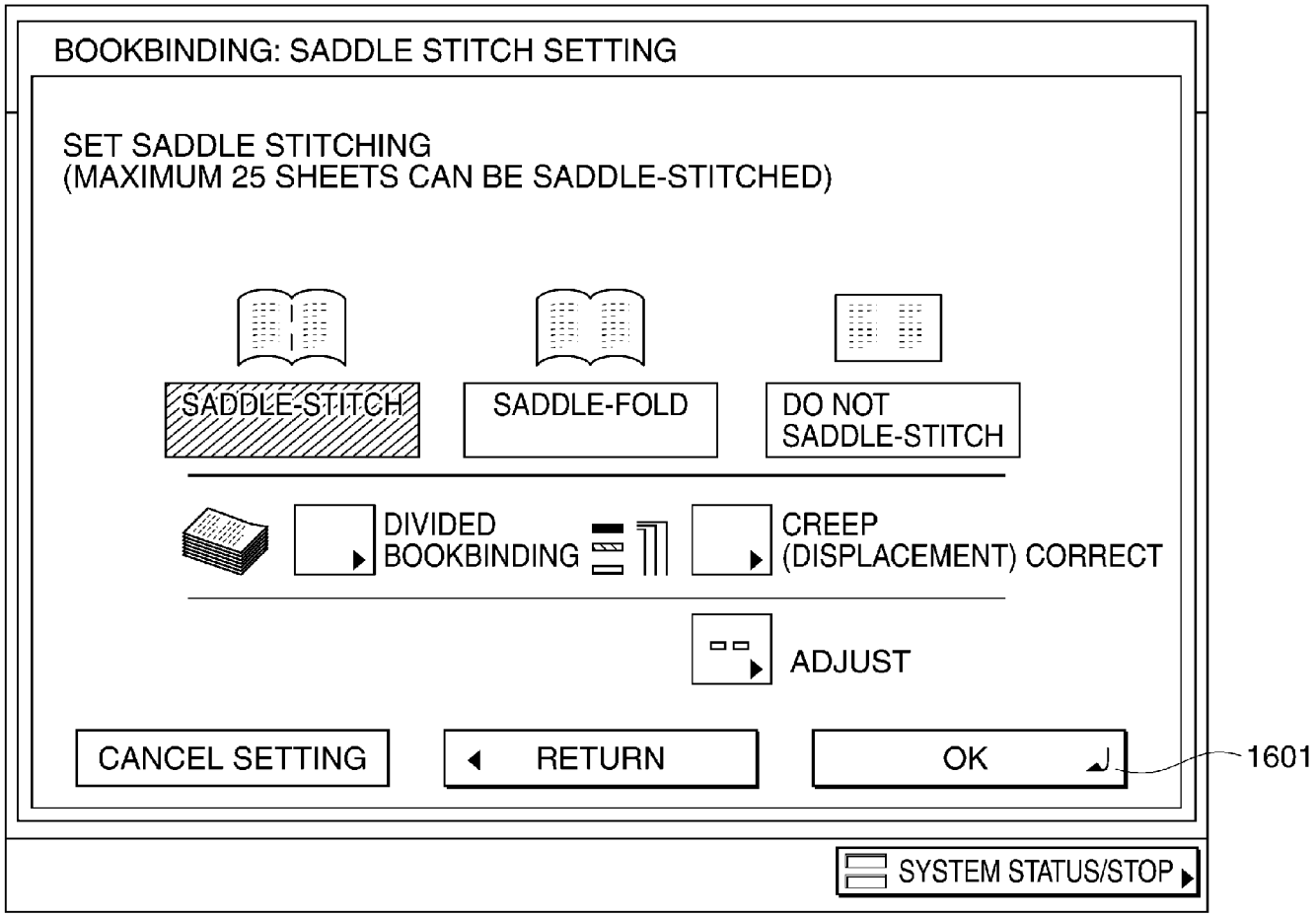
FIG. 15 is a view of an example of a saddle-stitching configuration screen for bookbinding, displayed on the display section.

When the user presses a "next" button 1501 on the screen shown in FIG. 14, a screen illustrated in FIG. 15 is displayed. This screen is used for configuring settings of the finish of the brochure. There are three finished forms of the brochure as described hereafter.

Form 1: saddle-stitched (by executing a saddle-stitch bookbinding process)

Form 2: saddle-folded (by executing a center folding bookbinding process)

Form 3: non-saddle-stitched (by executing a bookbinding layout process)

In the case of Form 1, sheets printed by the printing apparatus 300 are conveyed into the finisher 315, and are accumulated by the stopper 44 at a location, shown in FIG. 5, in the finisher 315. Then, when a predetermined number of printed sheets are accumulated in an aligned state, a stapling process for stapling the centers of the sheets is performed by the stapler 42. After that, the sheets subjected to the stapling process are subjected to a folding process for folding the sheets into two by the thrust plate 43 and the folding rollers 45 and 46, and are conveyed by the bundle conveyance roller pair 47, thereby being discharged onto the saddle-stitched product tray 331.

In the case of Form 2, sheets printed by the printing apparatus 300 are conveyed into the finisher 315, and are accumulated at the location, shown in FIG. 5, in the finisher 315. Then, when a predetermined number of printed sheets are accumulated in an aligned state, the sheets are subjected to the folding process for folding the sheets into two by the thrust plate 43 and the folding rollers 45 and 46, and are conveyed by the bundle conveyance roller pair 47, thereby being discharged onto the saddle-stitched product tray 331. In this case, the stapling process is not executed.

In the case of Form 3, although page images are arranged in a bookbinding layout, sheets are discharged without being subjected to the stapling process or the folding process. In this case, the sheets are discharged, not onto the saddle-stitched product tray 331, but onto the stacking tray 328.

Figure 16:
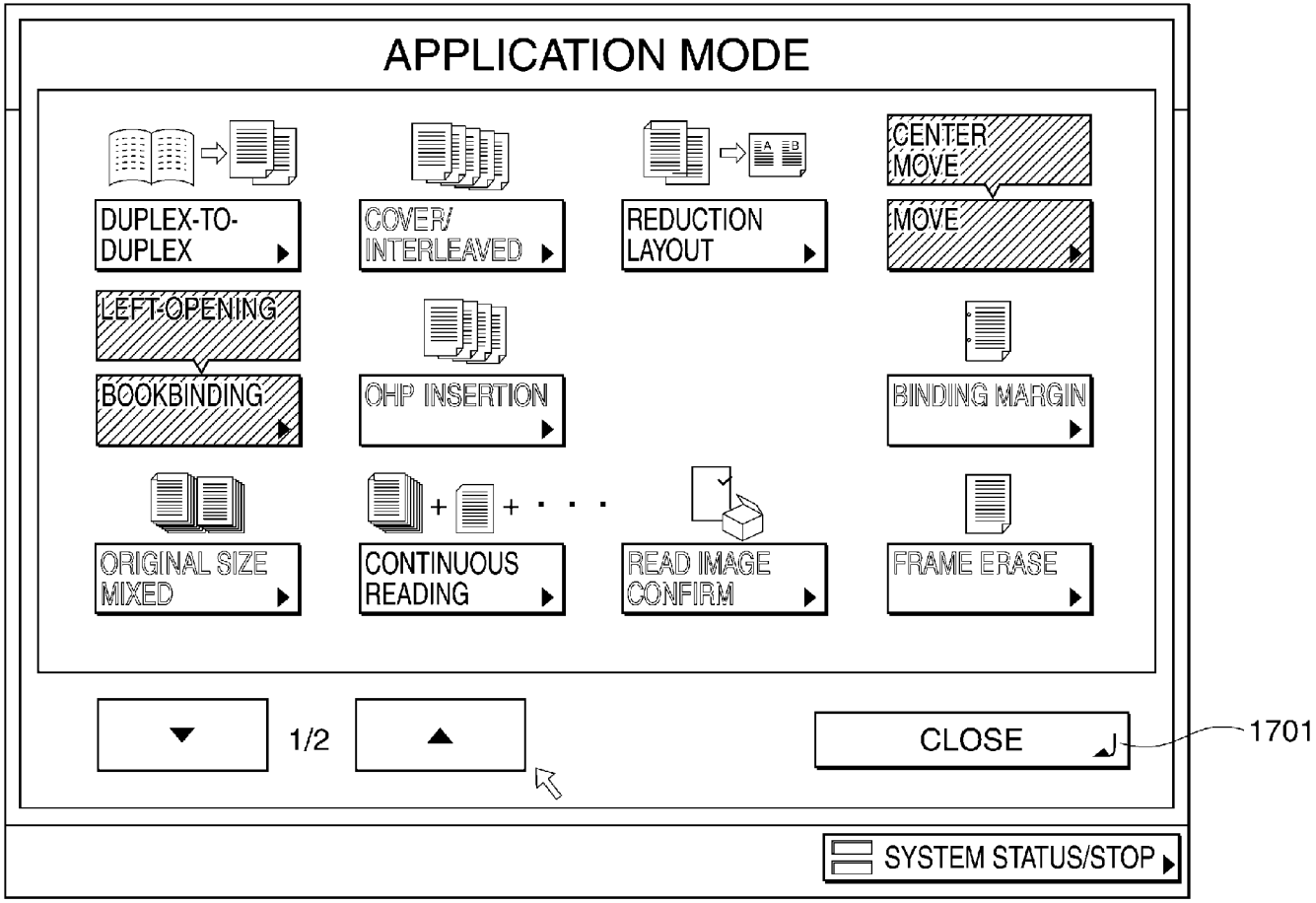
FIG. 16 is a view of an example of the application mode configuration screen displayed on the display section after the application mode has been set.

When the finish of the brochure is set and an "OK" key 1601 is pressed on the screen appearing in FIG. 15, a screen illustrated in FIG. 16 is displayed. The CPU 402 stores the settings received via the screens shown in FIGS. 12 to 15 in the DRAM 406. When displaying the screen illustrated in FIG. 16, the CPU 402 causes the settings of the finish of the brochure to be displayed thereon. Then, when the user presses a "close" button 1701 on the screen illustrated in FIG. 16, the CPU 402 causes a screen illustrated in FIG. 17 to be displayed.

Figure 17:
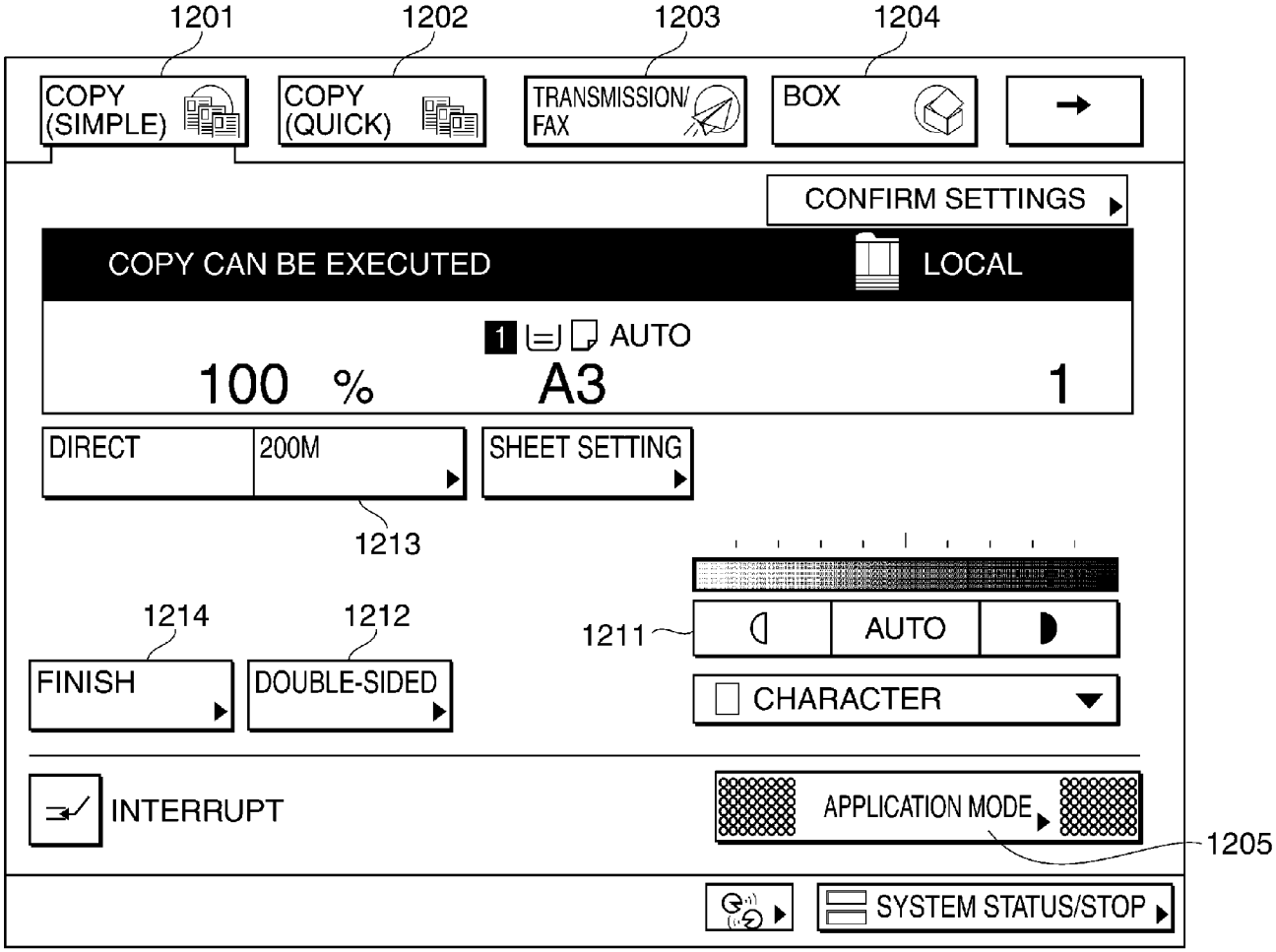
FIG. 17 is a view of an example of the standard screen displayed on the display section after the application mode has been set.

When the user presses the start key 506 on the console section 501 in a state where the screen illustrated in FIG. 17 is displayed, the CPU 402 starts an original reading operation by the scanner section 301 and a printing operation by the printer section 313, according to the settings stored in the DRAM 406.

By performing the above-described operations, the user can obtain a brochure by the bookbinding process.

However, the number of sheets that can be processed at once is limited due to the capabilities (sheet stapling capability and sheet folding capability) of the finisher 315. Since the capabilities of the folding rollers 45 and 46 are limited, only 25 sheets, for example, can be folded at once. When the number of sheets required to print images in the saddle-stitching process exceeds 25, the CPU 402 discharges the sheets onto the stacking tray 328 without executing the stapling process or the folding process on the sheets. In this case, the user obtains a brochure by separately executing the stapling process or the folding process on the sheets, using a sheet post-processing apparatus dedicated to bookbinding, which is called an off-line finisher.

Image layouts and printing results obtained by executing the bookbinding layout process and discharging resulting sheets onto the stacking tray 328 and image layouts and printing results obtained by executing the saddle-stitch bookbinding process and discharging resulting sheets onto the saddle-stitched product tray 331 will be described in detail with reference to FIGS. 18A to 18C and FIGS. 19A to 19D.

Figure 18A:
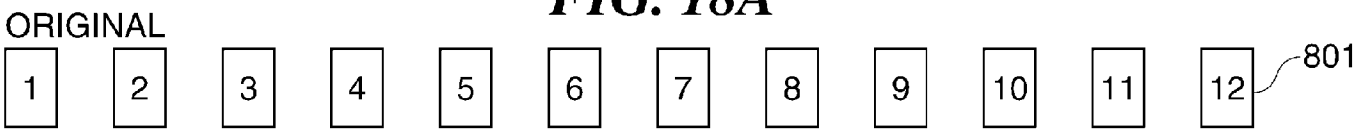
FIGS. 18A to 18C are views useful in explaining a method for laying out images during a bookbinding layout process.
Figure 18B:
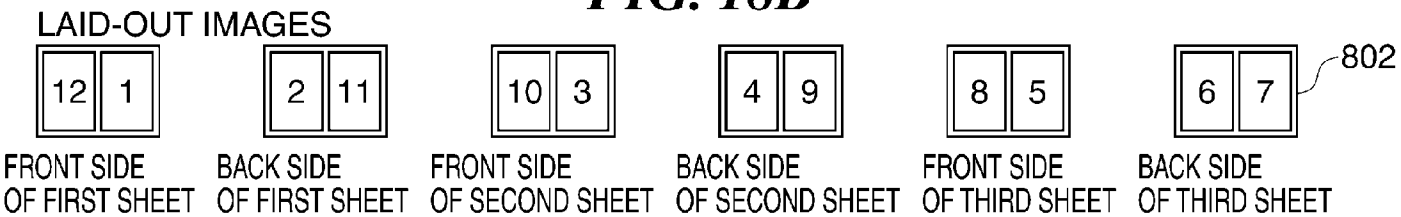
Figure 18C:
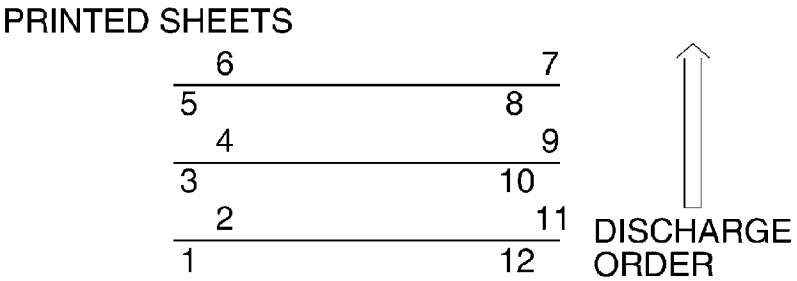

FIGS. 18A to 18C are views useful in explaining a method for laying out pages of original images when the bookbinding layout process is executed for a brochure of the left-opening type and discharging sheets onto the stacking tray 328.

In the case where sheets are discharged onto the stacking tray 328, for example, for pages 801 illustrated in FIG. 18A, images 802 are laid out respectively as illustrated in FIG. 18B and image data thereof is stored in the DRAM 406. When the layout of the images is completed, the images are sequentially printed in an order starting from an image for a sheet corresponding to an outermost part of a body of the brochure and ending in an image for a sheet corresponding to an innermost part of the brochure. In a case where the images are laid out as shown in FIG. 18B, the CPU 402 prints the images in the order of the front side of a first sheet, the back side of the first sheet, the front side of a second sheet, the back side of the second sheet, the front side of a third sheet, and the back side of the third sheet. Then, each sheet having associated images printed thereon is conveyed by the conveying roller pairs 31 to 35 and discharged onto the stacking tray 328. The printed sheets are discharged as shown in FIG. 18C.

FIGS. 19A to 19D are views useful in explaining a method for laying out pages of original images when the saddle-stitch bookbinding process is executed for a brochure of the left-opening type and discharging sheets onto the saddle-stitched product tray 331

Figure 19A:
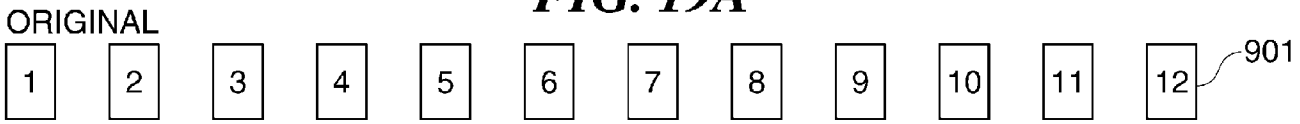
FIGS. 19A to 19D are views useful in explaining a method for laying out images during a saddle-stitch bookbinding process.
Figure 19B:
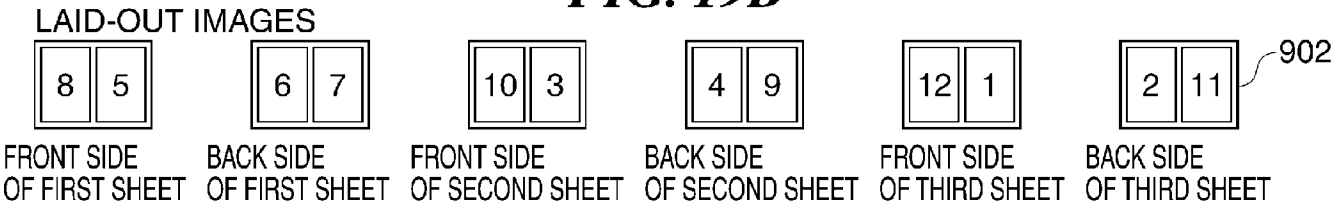
Figure 19C:
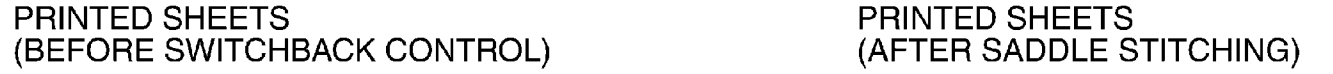
Figure 19D:
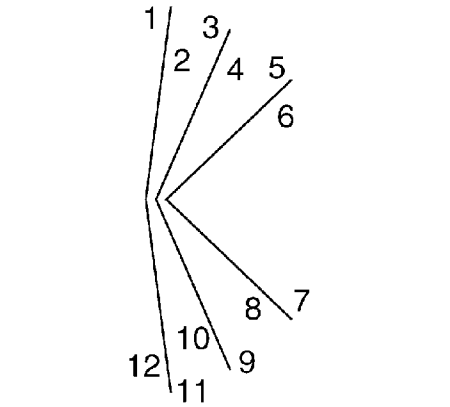

In the case where sheets are discharged onto the saddle-stitched product tray 331, for example, for pages 901 illustrated in FIG. 19A, images 902 are laid out respectively as illustrated in FIG. 19B and image data thereof is stored in the DRAM 406. When the layout of the images is completed, the images are sequentially printed in an order starting from an image for a sheet corresponding to an innermost part of a body of the brochure and ending in an image for a sheet corresponding to an outermost part of the brochure. In a case where the images are laid out as shown in FIG. 19B, the CPU 402 prints the images in the order of the front side of a first sheet, the back side of the first sheet, the front side of a second sheet, the back side of the second sheet, the front side of a third sheet, and the back side of the third sheet. Each sheet having associated images printed thereon is conveyed by the conveying roller pairs 31, 37 and 38 until the trailing edge thereof reaches the trailing-edge detection sensor 48, and is then switched back by reverse rotation of the conveying roller pairs 37 and 38. The printed sheets are thus sequentially accumulated in the conveying path 41 (second conveying path). Then, after execution of the stapling process, the folding process is executed, and the sheets are discharged onto the saddle-stitched product tray 331. The printed sheets are discharged as shown in FIG. 19C. When the number of sheets required to print the stored images is not larger than 25, the CPU 402 executes the stapling process and the folding process according to a layout method shown in FIG. 19D and cause the sheets to be discharged.

As shown in FIGS. 18A to 18C and FIGS. 19A to 19D, the brochure discharged onto the stacking tray 328 is distinguished from the brochure discharged onto the saddle-stitched product tray 331 only in that the stapling process and the folding process are not executed on the brochure discharged onto the stacking tray 328, and hence it is possible to obtain two types of brochures having the same image layout.

Figure 20:
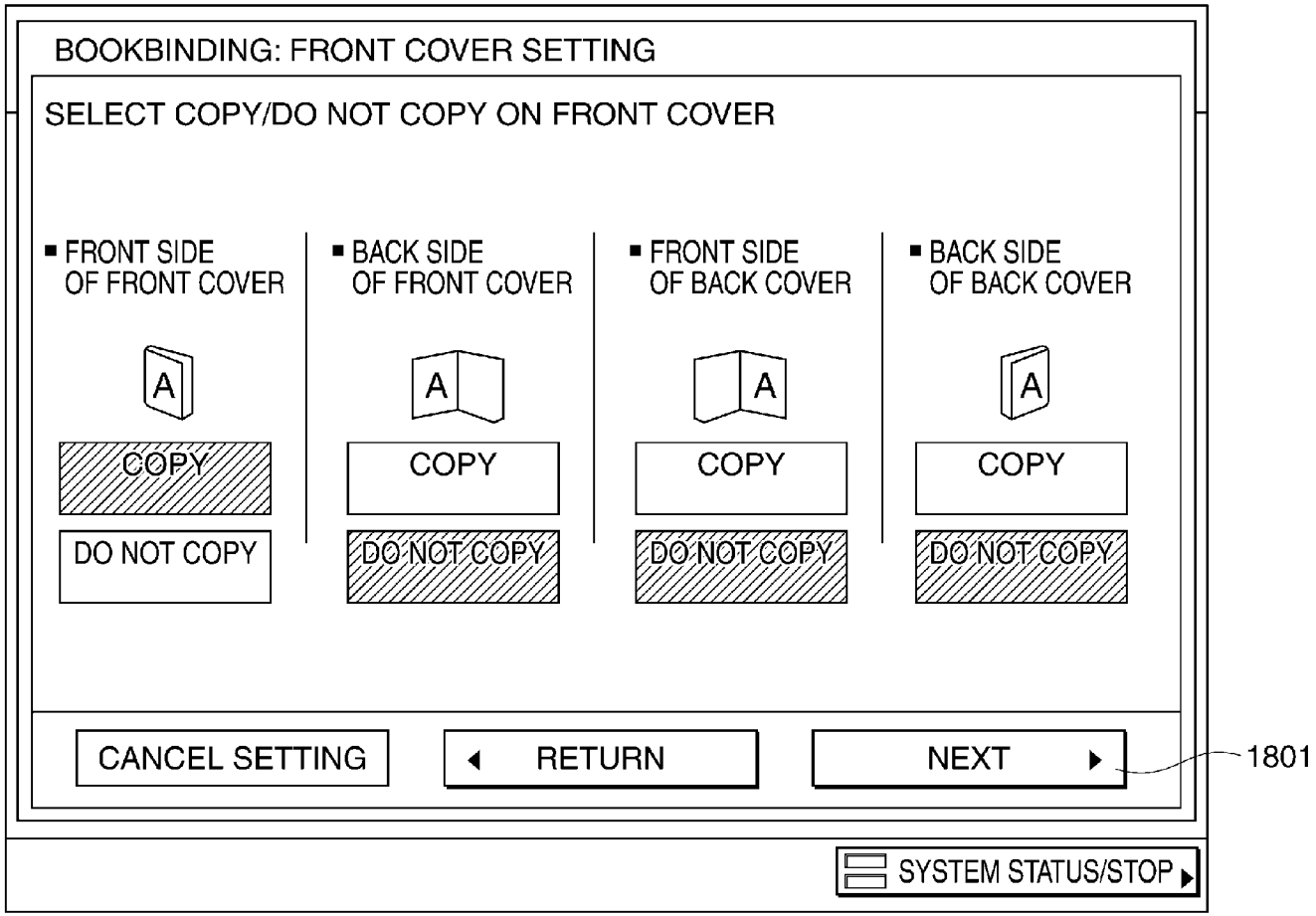
FIG. 20 is a view of an example of a cover configuration screen for bookbinding, displayed on the display section.
Figure 21:
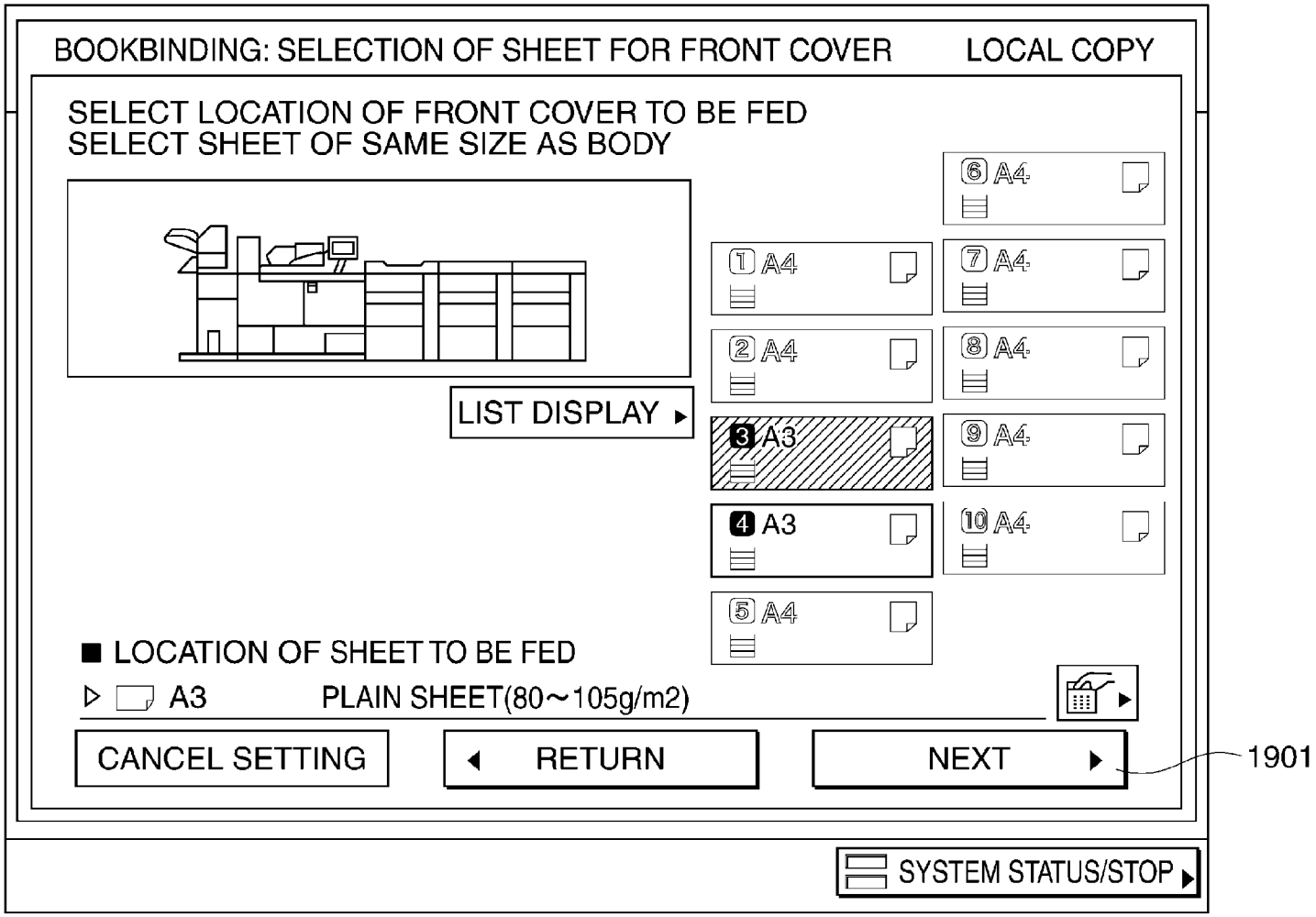
FIG. 21 is a view of an example of a cover sheet selection screen for bookbinding, displayed on the display section.

On the other hand, in a case where the user configures settings of the bookbinding process using the screens in FIGS. 11 to 16, the user can use the function for adding a cover to the brochure by pressing a "cover addition" button 1502 included in the screen appearing in FIG. 14. For example, when the user presses the "next" button 1501 on the screen shown in FIG. 14 in a state where the "cover addition" button 1502 is selected, a screen illustrated in FIG. 20 is displayed. The user can set on which side of a cover an image or images is/are to be printed, on the screen illustrated in FIG. 20. In the illustrated example, it is possible to set whether or not to execute copying an image, for each of the front side of a front cover, the back side of the front cover, the front side of a back cover, and the back side of the back cover. Then, when the user presses a "next" button 1801 on the screen shown in FIG. 20, a screen illustrated in FIG. 21 is displayed. The user selects a sheet size of a cover of the brochure via the screen illustrated in FIG. 21. Next, when the user presses a "next" button 1901 on the screen shown in FIG. 21, the screen illustrated in FIG. 15 is displayed.

Figure 22A:
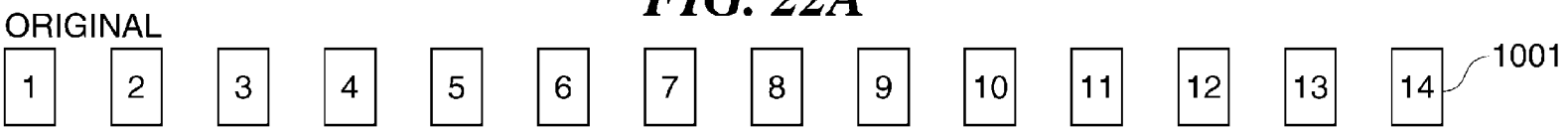
FIGS. 22A to 22C are views useful in explaining a method for laying out images during the bookbinding layout process when cover addition is set.
Figure 22B:
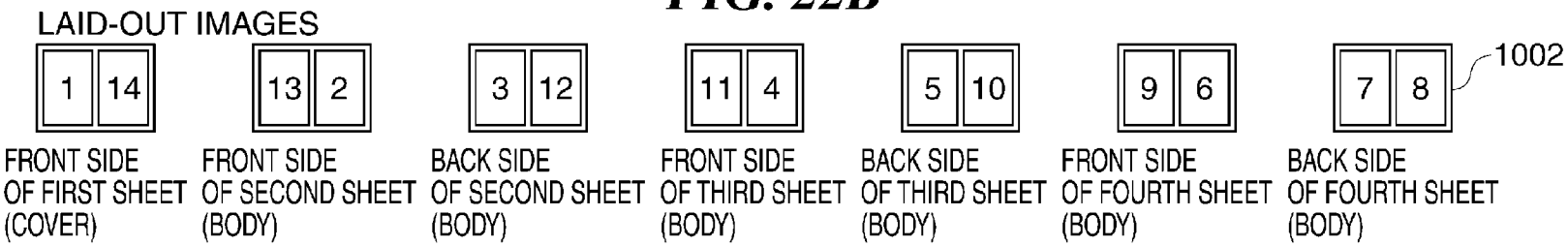
Figure 22C:
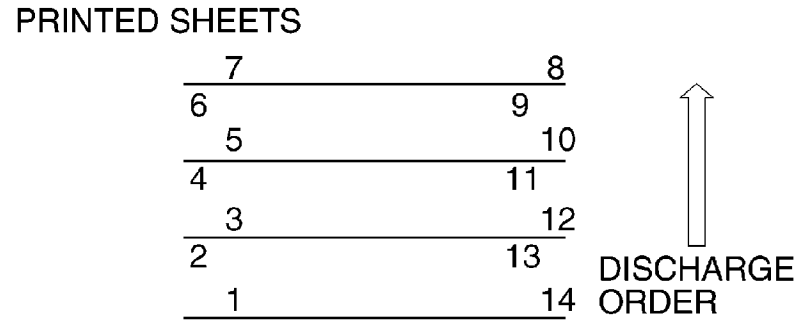

FIGS. 22A to 22C are views useful in explaining a method for laying out pages of original images, in a case where the bookbinding layout process including cover addition is executed for a brochure of the left-opening type and sheets are discharged onto the stacking tray 328.

In the case where sheets are discharged onto the stacking tray 328, for example, for pages 1001 illustrated in FIG. 22A, images 1002 are laid out respectively as illustrated in FIG. 22B and image data thereof is stored in the DRAM 406. When the layout of the images is completed, the images are sequentially printed in an order starting from images for a sheet corresponding to the cover of a brochure and then proceeding to images for sheets corresponding to a body of the brochure. Note that in a case where a sheet, such as thick paper having a large basis weight, which cannot be subjected to double-sided printing, is used as the cover of the brochure, the sheet cannot be switched back to be conveyed into the double-sided printing sheet conveying path 330, and hence a side of the sheet corresponding to the inner side of the cover, that is, only the back side of the front cover and the front side of the back cover, as appearing in FIG. 20, can be printed.

Now, in a case where the laid-out images are arranged as shown in FIG. 22B, first, the CPU 402 prints the front side of a first sheet (cover). Then, the CPU 402 prints the images in the order of the front side of a second sheet (body), the back side of the second sheet (body), the front side of a third sheet (body), the back side of the third sheet (body), the front side of a fourth sheet (body), and the back side of the fourth sheet (body). Each sheet having associated image(s) printed thereon is conveyed by the conveying roller pairs 31 to 35 and is discharged onto the stacking tray 328. The printed sheets are discharged as shown in FIG. 22C.

FIGS. 23A to 23D are views useful in explaining a method of laying out pages of original images, when the saddle-stitch bookbinding process including cover addition is executed for a brochure of the left-opening type and sheets are discharged onto the saddle-stitched product tray 331.

In the case where sheets are discharged onto the saddle-stitched product tray 331, for example, for pages 1101 illustrated in FIG. 23A, images 1102 are laid out respectively as illustrated in FIG. 23B and image data thereof is stored in the DRAM 406. When the layout of the images is completed, the images are sequentially printed in an order starting from images for sheets corresponding to the body of the brochure and ending in images for a sheet corresponding to the cover of the brochure. In a case where the laid-out images are arranged as shown in FIG. 23B, first, the CPU 402 prints the images in the order of the front side of a first sheet (body), the back side of the first sheet (body), the front side of a second sheet (body), the back side of the second sheet (body), the front side of a third sheet (body), and the back side of the third sheet (body). Then, finally, the CPU 402 prints the front side of a fourth sheet (cover). Next, each sheet having associated image(s) printed thereon is conveyed by the conveying roller pairs 31, 37 and 38 until the trailing edge of the sheet reaches the trailing-edge detection sensor 48, and is then switched back by reverse rotation of the conveying roller pairs 37 and 38. The printed sheets are thus sequentially accumulated in the conveying path 41. Then, after execution of the stapling process, the folding process is executed, and the sheets are discharged onto the saddle-stitched product tray 331. The printed sheets are discharged as shown in FIG. 23D.

As shown in FIGS. 22A to 22C and FIGS. 23A to 23D, even when a cover is added to the brochure, the brochure discharged onto the stacking tray 328 is distinguished from the brochure discharged onto the saddle-stitched product tray 331 only in that the stapling process and the folding process are not executed on the brochure discharged onto the stacking tray 328. Therefore, when a sheet which cannot be subjected to double-sided printing is used as the cover of the brochure, it is only required for the user to configure settings of the cover on the screen illustrated in FIG. 20, while being conscious that only the side of the sheet corresponding to the inner side of the cover can be printed, regardless of a discharge destination of the brochure.

Next, the bookbinding process executed by the printing apparatus 300 will be described with reference to FIGS. 24A and 24B. The present process is realized by the CPU 402 by executing the program stored in the ROM 404.

Referring to FIG. 24A, first, upon receipt of a job execution request by the start key 506, the CPU 402 starts the present process. For example, in a case where the CPU 402 receives a copy job execution request which requests original images read by the scanner section 301 to be printed by the printer section 313, the CPU 402 lays out and prints the original images and performs the illustrated process on sheets having the original images printed thereon. Also, in a case where the CPU 402 receives a print job execution request which requests images received from an external PC to be printed by the printer section 313, the CPU 402 lays out and prints the images received from the external PC and performs the illustrated process on sheets having the images printed thereon.

In a step S5001, the CPU 402 determines whether or not bookbinding is designated. If it is determined that bookbinding is designated, the CPU 402 proceeds to a step S5004, whereas if it is determined that bookbinding is not designated, the CPU 402 proceeds to a step S5002.

In the step S5002, the CPU 402 decides that a sheet discharge destination is the stacking tray 328, and proceeds to a step S5003. In the step S5003, the CPU 402 executes a normal printing process based on settings other than those of the bookbinding, which are designated by the user. This corresponds, for example, to a case where the CPU 402 performs printing using the printing apparatus 300 and discharges sheets onto the stacking tray 328, instead of executing post-processing by the finisher 315.

On the other hand, in the step S5004, the CPU 402 determines whether or not saddle-stitch bookbinding is designated. The step S5004 corresponds to an operation of a first determination unit. If it is determined that saddle-stitch bookbinding is designated, the CPU 402 proceeds to a step S5006, whereas if it is determined that saddle-stitch bookbinding is not designated, the CPU 402 proceeds to a step S5005. In the step S5005, the CPU 402 decides that the discharge destination is the stacking tray 328, and proceeds to a step S5009. The step S5009 corresponds to an operation of a discharge destination decision unit.

On the other hand, in the step S5006, the CPU 402 calculates the number of sheets per one copy, and proceeds to a step S5007. As shown in FIG. 18B, when two pages of image are laid out on one page, the number of sheets per one copy is calculated by a computational expression of (total number of pages+3)/4. The step S5006 corresponds to an operation of a calculation unit.

In the step S5007, the CPU 402 determines whether or not the number of sheets per one copy exceeds a saddle-stitchable number of sheets which the finisher 315 can saddle-stitch at once. The step S5007 corresponds to an operation of a comparison unit. If it is determined that the saddle-stitchable number is exceeded, the CPU 402 proceeds to the step S5005, whereas if not, the CPU 402 proceeds to a step S5008 appearing in FIG. 24B.

After deciding in the step S5005 that the discharge destination is the stacking tray 328, in the step S5009, the CPU 402 determines whether or not cover addition is designated. The step S5009 corresponds to an operation of a second determination unit. If it is determined that cover addition is designated, the CPU 402 proceeds to a step S5010, whereas if not, the CPU 402 proceeds to a step S5011.

In the step S5010, the CPU 402 performs layout of pages by the method shown in FIG. 22B, and then proceeds to a step S5012.

In the step S5012, the CPU 402 performs image forming processing on a sheet corresponding to the cover, and then proceeds to a step S5013.

In the step S5013, the CPU 402 causes the sheet corresponding to the cover to be discharged without executing the stapling process or the folding process thereon, and proceeds to a step S5014. In the above case, the sheet is discharged not onto the saddle-stitched product tray 331 but onto the stacking tray 328.

On the other hand, in the step S5011, the CPU 402 performs layout of pages by the method shown in FIG. 18B, and then proceeds to the step S5014.

In the step S5014, the CPU 402 performs image forming processing on sheets corresponding to the body, and proceeds to a step S5015. In the step S5015, the CPU 402 causes the sheets corresponding to the body to be discharged onto the stacking tray 328 without executing the stapling process or the folding process thereon. The steps S5009 to S5015 correspond to an operation of a first control unit. Particularly, the step S5010 corresponds to an operation of a third control unit.

Figure 24B:
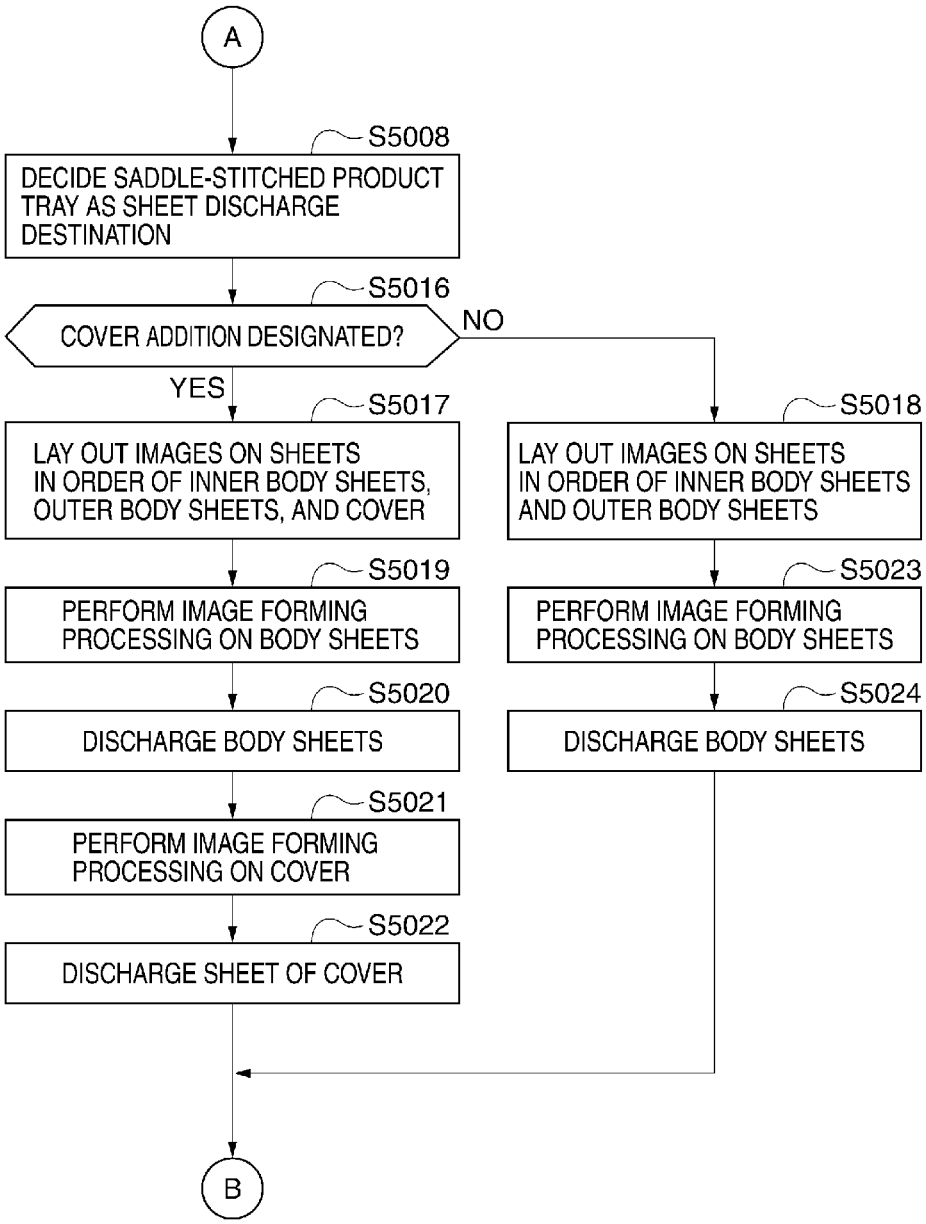
FIG. 24B is a continuation of FIG. 24A.
Figure 25B:
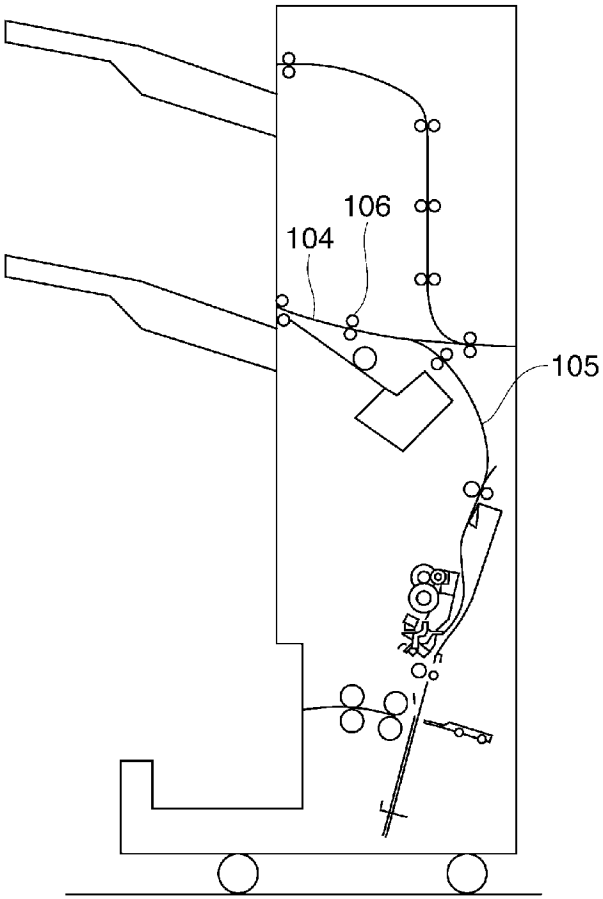
FIG. 25B is a schematic view of another conventional sheet post-processing apparatus.
Figure 25A:
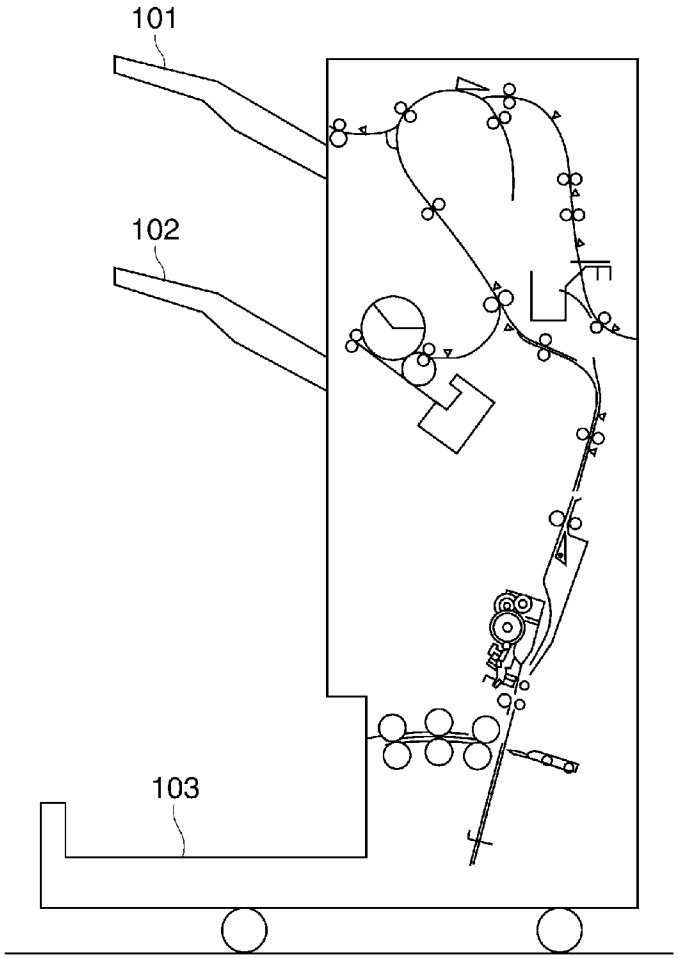
FIG. 25A is a schematic view of a conventional sheet post-processing apparatus.

On the other hand, in the step S5008 appearing in FIG. 24B, the CPU 402 decides that the discharge destination is the saddle-stitched product tray 331, and proceeds to a step S5016. The step S5008 corresponds to an operation of a discharge destination decision unit. As described above, the discharge destination of sheets is decided based on a result of comparison by the comparison unit.

Next, in the step S5016, the CPU 402 determines whether or not cover addition is designated. The step S5016 corresponds to an operation of a second determination unit. If it is determined that cover addition is designated, the CPU 402 proceeds to a step S5017, whereas if not, the CPU 402 proceeds to a step S5018.

In the step S5017, the CPU 402 performs layout of pages by the method shown in FIG. 23B, and proceeds to a step S5019. In the step S5019, the CPU 402 performs image forming processing on sheets corresponding to the body, and proceeds to a step S5020.

In the step S5020, the CPU 402 causes the sheets corresponding to the body to be each switched back by the conveying roller pairs 37 and 38, and be sequentially accumulated in the conveying path 41.

In a step S5021, the CPU 402 performs image forming process on the sheet corresponding to the cover, and proceeds to a step S5022.

In the step S5022, the CPU 402 causes the sheet corresponding to the cover to be switched back by the conveying roller pairs 37 and 38, and then be accumulated in the conveying path 41. Then, after performing the stapling process on the sheets, the CPU 402 performs the folding process thereon, and causes the sheets to be discharged onto the saddle-stitched product tray 331.

On the other hand, in the step S5018, the CPU 402 performs layout of pages by the method shown in FIG. 19B, and proceeds to a step S5023. In the step S5023, the CPU 402 performs image forming processing on sheets corresponding to the body, and proceeds to a step S5024.

In the step S5024, the CPU 402 causes the sheets corresponding to the body to be each switched back by the conveying roller pairs 37 and 38, and then sequentially accumulated in the conveying path 41. Then, after performing the stapling process on the sheets, the CPU 402 performs the folding process thereon, and causes the sheets to be discharged onto the saddle-stitched product tray 331. The steps S5016 to S5024 correspond to an operation of a second control unit. Particularly, the step S5017 corresponds to an operation of a fourth control unit.

By performing the above-described control, the order of image formation is controlled, so that the user can obtain brochures having the same layout of images even at different sheet discharge destinations of the sheet post-processing apparatus equipped with a switchback mechanism. Further, even when the number of sheets per one copy exceeds the saddle-stitchable number, the user can obtain brochures having the same layout of images, and hence it is possible to enhance working efficiency of the user when the user designates a bookbinding process.

Although in the above-described embodiment, the description has been given of the case where the number of sheets saddle-stitchable by the finisher 315 is 25, the saddle-stitchable number is not limited to the value Further, although in the above-described embodiment, the description has been given of the method of laying out pages of original images for a brochure of the left-opening type, the brochure is not limited to the left-opening type.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2012-249426 filed Nov. 13, 2012, which is hereby incorporated by reference herein in its entirety.

What is claimed is:

1. A printing apparatus comprising:

a conveying unit configured to convey sheets to a post-processing apparatus that is equipped with a stacking tray onto which a sheet is discharged from the printing apparatus, a saddle-stitched product tray onto which a brochure formed by executing a saddle-stitch bookbinding process on a plurality of sheets is discharged, and a conveying path along which the sheets to be subjected to execution of the saddle-stitch bookbinding process are switched back;

a first determination unit configured to determine whether or not the execution of the saddle-stitch bookbinding process is designated;

a discharge destination decision unit configured, when said first determination unit determines that execution of the saddle-stitch bookbinding process is designated, to decide between the stacking tray and the saddle-stitched product tray as a sheet discharge destination based on a number of sheets per one copy and a saddle-stitchable number of sheets capable of being saddle-stitched by the post-processing apparatus;

a first control unit configured, in a case where said discharge destination decision unit decides that the discharge destination is the stacking tray, to control an order of image formation such that a sheet corresponding to an outermost sheet of the brochure is discharged from the printing apparatus to the post-processing apparatus first and a sheet corresponding to an innermost sheet of the brochure is discharged from the printing apparatus to the post-processing apparatus last; and a second control unit configured, when said discharge destination decision unit decides that the discharge destination is the saddle-stitched product tray, to control the order of image formation such that a sheet corresponding to an innermost sheet of the brochure is discharged from the printing apparatus to the post-processing apparatus first and a sheet corresponding to an outermost sheet of the brochure is discharged from the printing apparatus to the post-processing apparatus last.

2. The printing apparatus according to claim 1, further comprising:

a second determination unit configured to determine whether or not addition of a cover to the brochure is designated;

a third control unit configured, when said second determination unit determines that addition of a cover to the brochure is designated and also said discharge destination decision unit decides that the discharge destination is the stacking tray, to control the order of image formation such that a sheet corresponding to a cover of the brochure is discharged from the printing apparatus to the post-processing apparatus and thereafter sheets corresponding to a body of the brochure are discharged from the printing apparatus to the post-processing apparatus; and a fourth control unit configured, when said second determination unit determines that addition of a cover to the brochure is designated and also said discharge destination decision unit decides that the discharge destination is the saddle-stitched product tray, to control the order of image formation such that the sheets corresponding to the body of the brochure are discharged from the printing apparatus to the post-processing apparatus and thereafter the sheet corresponding to the cover of the brochure is discharged from the printing apparatus to the post-processing apparatus.

3. The printing apparatus according to claim 1, further comprising:

a calculation unit configured to calculate the number of sheets per one copy based on a number of pages of the image data, and wherein said discharge destination decision unit decides the sheet discharge destination based on the number of sheets per one copy calculated by said calculation unit and the saddle-stitchable number of sheets capable of being saddle-stitched by the post-processing apparatus.

4. The printing apparatus according to claim 1, further comprising a printing unit configured to print images after the order of image formation has been controlled by said first control unit or said second control unit.

5. A method of controlling a printing apparatus comprising:

conveying sheets to a post-processing apparatus that is equipped with a stacking tray onto which a sheet is discharged from the printing apparatus, a saddle-stitched product tray onto which a brochure formed by executing a saddle-stitch bookbinding process on a plurality of sheets is discharged, and a conveying path along which the sheets to be subjected to execution of the saddle-stitch bookbinding process are switched back;

determining whether or not the execution of the saddle-stitch bookbinding process is designated;

deciding, when said determining determines that execution of the saddle-stitch bookbinding process is designated, between the stacking tray and the saddle-stitched product tray as a sheet discharge destination based on a number of sheets per one copy and a saddle-stitchable number of sheets capable of being saddle-stitched by the post-processing apparatus;

controlling, when said deciding decides that the discharge destination is the stacking tray, an order of image formation such that a sheet corresponding to an outermost sheet of the brochure is discharged from the printing apparatus to the post-processing apparatus first and a sheet corresponding to an innermost sheet of the brochure is discharged from the printing apparatus to the post-processing apparatus last; and controlling, when said deciding decides that the discharge destination is the saddle-stitched product tray, the order of image formation such that a sheet corresponding to an innermost sheet of the brochure is discharged from the printing apparatus to the post-processing apparatus first and a sheet corresponding to an outermost sheet of the brochure is discharged from the printing apparatus to the post-processing apparatus last.

6. A non-transitory computer-readable storage medium storing a computer-executable program for causing a post-processing apparatus to execute a method of controlling a printing apparatus, wherein the method comprises:

conveying sheets to a post-processing apparatus that is equipped with a stacking tray onto which a sheet is discharged from the printing apparatus, a saddle-stitched product tray onto which a brochure formed by executing a saddle-stitch bookbinding process on a plurality of sheets is discharged, and a conveying path along which the sheets to be subjected to execution of the saddle-stitch bookbinding process are switched back;

determining whether or not the execution of the saddle-stitch bookbinding process is designated;

deciding, when said determining determines that execution of the saddle-stitch bookbinding process is designated, between the stacking tray and the saddle-stitched product tray as a sheet discharge destination based on a number of sheets per one copy and a saddle-stitchable number of sheets capable of being saddle-stitched by the post-processing apparatus;

controlling, when said deciding decides that the discharge destination is the stacking tray, an order of image formation such that a sheet corresponding to an outermost sheet of the brochure is discharged from the printing apparatus to the post-processing apparatus first and a sheet corresponding to an innermost sheet of the brochure is discharged from the printing apparatus to the post-processing apparatus last; and controlling, when said deciding decides that the discharge destination is the saddle-stitched product tray, the order of image formation such that a sheet corresponding to an innermost sheet of the brochure is discharged from the printing apparatus to the post-processing apparatus first and a sheet corresponding to an outermost sheet of the brochure is discharged from the printing apparatus to the post-processing apparatus last.

7. A printing apparatus that is connected to a post-processing apparatus, to which the printing apparatus passes a printed sheet which has an image printed thereon, wherein the post-processing apparatus is configured to discharge printed sheets, each of which has an image printed thereon, to a first discharge unit without the printed sheets reversed nor subjected to execution of saddle-stitch bookbinding process, and discharge the printed sheets to a second discharge unit with the printed sheets reversed and subjected to the execution of the saddle-stitch bookbinding process, the printing apparatus comprising:

a reception unit configured to receive setting for executing the saddle-stitch bookbinding process;

a determination unit configured to determine whether or not the number of sheets used for a print of one copy exceeds a executable number of sheets which can be subjected to the saddle-stitch bookbinding process;

a control unit configured to, in a case where the reception unit receives the setting for executing the saddle-stitch bookbinding process, control the printing apparatus to pass the printed sheets to the post-processing apparatus in a first order when the determination unit determines that the number of the sheets used for the print of the one copy exceeds the executable number of sheets, and control the printing apparatus to pass the printed sheets to the post-processing apparatus in a second order, which is reverse to the first order, when the determination unit determines that the number of the sheets used for the print of the one copy does not exceed the executable number of sheets.

8. The printing apparatus according to claim 7, wherein, in a case of the first order, a sheet corresponding to an outermost sheet of a folded brochure is passed to the post-processing apparatus first, and a sheet corresponding to an innermost sheet of the folded brochure is passed to the post-processing apparatus last, and in a case of the second order, the sheet corresponding to the innermost sheet of the folded brochure is passed to the post-processing apparatus first, and the sheet corresponding to the outermost sheet of the folded brochure is passed to the post-processing apparatus last.

9. The printing apparatus according to claim 7, wherein the control unit controls the printing apparatus to pass a sheet used as a cover to the post-processing apparatus prior to the other sheets when the determination unit determines that the number of the sheets used for the print of the one copy exceeds the executable number of sheets, and controls the printing apparatus to pass the sheet used as the cover to the post-processing apparatus posterior to the other sheets when the determination unit determines that the number of the sheets used for the print of the one copy does not exceed the executable number of sheets.

10. The printing apparatus according to claim 7, wherein the saddle-stitch bookbinding process includes a stapling process and a folding process.

11. The printing apparatus according to claim 7, wherein the reverse of the printed sheet is executed by the post-processing apparatus for each sheet.

12. The printing apparatus according to claim 7 further comprising a reading unit configured to read an image formed on an original, wherein the control unit controls to print the image read by the reading unit on a sheet.

13. The printing apparatus according to claim 7, wherein, in a case where images are printed on sheets by the printing apparatus and the printed sheets are passed to the post-processing apparatus in the first order, all of the printed sheets which compose the one copy are discharged to the first discharge unit, and in a case where images are printed on the sheets by the printing apparatus and the printed sheets are passed to the post-processing apparatus in the second order, all of the printed sheets which compose the one copy are discharged to the second discharge unit.

* * * * *